US009908750B2

(12) United States Patent
Sturm, Jr. et al.

(10) Patent No.: US 9,908,750 B2
(45) Date of Patent: Mar. 6, 2018

(54) TENSILE TRUSS MAST

(75) Inventors: Albert J. Sturm, Jr., Stillwater, MN (US); Michael Hennessey, Prior Lake, MN (US); Mark Guterman, Eagan, MN (US)

(73) Assignee: PAR SYSTEMS, INC., Shoreview, MN (US)

( * ) Notice: Subject to any disclaimer, the term of this patent is extended or adjusted under 35 U.S.C. 154(b) by 0 days.

(21) Appl. No.: 13/078,801

(22) Filed: Apr. 1, 2011

(65) Prior Publication Data

US 2013/0126457 A1 May 23, 2013

Related U.S. Application Data

(60) Provisional application No. 61/369,165, filed on Jul. 30, 2010, provisional application No. 61/356,254, filed on Jun. 18, 2010, provisional application No. 61/320,094, filed on Apr. 1, 2010.

(51) Int. Cl.
*B66C 13/08* (2006.01)
*B66C 11/08* (2006.01)

(52) U.S. Cl.
CPC ..... *B66C 13/08* (2013.01); *B66C 11/08* (2013.01)

(58) Field of Classification Search
CPC ..... B66C 13/08; B66C 11/08
USPC ..... 254/278, 283, 284, 285, 286, 272, 273
See application file for complete search history.

(56) References Cited

U.S. PATENT DOCUMENTS 300,344 A * 6/1884 Chamblin et al. ..... 254/286
655,367 A 8/1900 Morgan
1,419,129 A 6/1922 Fitch
2,004,133 A * 6/1935 Romano ..... B63C 11/44 405/188
2,164,128 A * 6/1939 Medenwald ..... 182/36
2,720,327 A * 10/1955 Bain ..... 414/624
2,752,120 A 6/1956 Bogle
2,869,734 A 1/1959 Ernestus
3,043,444 A * 7/1962 Melton ..... B66C 1/34 212/274

(Continued)

FOREIGN PATENT DOCUMENTS

DE 2115587 10/1972
DE 3639651 A1 6/1988

(Continued)

OTHER PUBLICATIONS

European Search Report of the European Patent Office Patent Office in counterpart foreign application No. PCT/US2011/030995 filed Apr. 1, 2011, dated Sep. 5, 2012.

(Continued)

*Primary Examiner* — Michael E Gallion

(74) *Attorney, Agent, or Firm* — Steven M. Koehler; Westman, Champlin & Koehler, P.A.

(57) ABSTRACT

Hoist systems are provided. In one embodiment, a hoist system includes a lower platform, an upper platform, a plurality of flexible members, and a plurality of hoists. The upper platform has a plurality of rotatable support arms. The flexible members connect the rotatable support arms to the lower platform and can be extended and retracted using the plurality of hoists. If desired, the upper platform includes a plurality adjustable length support arms, and actuators may be used to extend and retract the support arms.

21 Claims, 18 Drawing Sheets

(56) References Cited

U.S. PATENT DOCUMENTS 3,045,839 A 7/1962 Hibberd
3,051,321 A 8/1962 Ramsden
3,104,016 A 9/1963 Harry
3,107,791 A * 10/1963 Michael ..... B63B 27/10 212/274
3,247,974 A 4/1966 Dechantsreiter
3,276,602 A 10/1966 Vogeley
3,476,263 A 11/1969 Komatsu Toshiro
3,536,351 A 10/1970 Zweifel
3,567,040 A * 3/1971 Thomson ..... 212/242
3,591,022 A 7/1971 Polyakov
3,671,069 A 6/1972 Martin
3,675,258 A 7/1972 Osmundson
3,743,107 A 7/1973 Verschoof
3,768,664 A * 10/1973 Bauer et al. ..... 212/310
3,825,128 A 7/1974 Cooper
3,837,503 A 9/1974 Komatsu
3,842,986 A 10/1974 Hupkes
3,874,513 A * 4/1975 Wilson ..... 212/290
3,874,514 A * 4/1975 Wilson ..... 212/290
3,874,516 A 4/1975 Watanabe
3,887,080 A * 6/1975 Wilson ..... 212/318
3,899,083 A 8/1975 Flessner
3,971,478 A 7/1976 Matasa
4,057,942 A * 11/1977 Kranefeld et al. ..... 52/115
4,076,127 A 2/1978 Hupkes
4,133,514 A * 1/1979 Anderson ..... 254/124
4,142,710 A * 3/1979 Okuda ..... 254/423
4,271,553 A 6/1981 Korsvik
4,360,112 A 11/1982 Brewer
4,406,244 A 9/1983 Buchan
4,687,110 A 8/1987 Partanen
4,761,112 A * 8/1988 Hammon et al. ..... 414/591
4,883,184 A * 11/1989 Albus ..... 212/274
4,949,855 A 8/1990 Foit
4,953,721 A 9/1990 Foit
5,074,528 A 12/1991 Long
5,150,799 A 9/1992 Long
5,257,891 A * 11/1993 Baumann et al. ..... 414/460
5,261,347 A 11/1993 Mansfield
5,489,033 A 2/1996 Luebke
5,507,596 A * 4/1996 Bostelman ..... B63B 38/00 166/355
5,520,135 A 5/1996 Rolland
5,585,707 A * 12/1996 Thompson ..... B25J 5/00 318/568.1
5,628,416 A * 5/1997 Frommelt et al. ..... 212/292
5,765,703 A * 6/1998 Shiwaku ..... 212/274
5,769,250 A 6/1998 Jussila
5,819,962 A 10/1998 Okubo
6,023,862 A * 2/2000 Sirjola ..... 37/397
6,126,023 A * 10/2000 Durrant-Whyte et al. ... 212/274
6,182,843 B1 2/2001 Tax
6,216,895 B1 * 4/2001 Erdmann et al. ..... 212/292
6,343,702 B1 2/2002 Masumoto
6,374,147 B1 * 4/2002 Rockwood ..... 700/69
6,382,437 B1 5/2002 Okada
6,439,407 B1 8/2002 Jacoff
6,474,486 B1 * 11/2002 Baraniak ..... 212/292
6,494,155 B2 12/2002 Gibson
6,566,834 B1 * 5/2003 Albus ..... B25J 9/1623 318/566
6,644,486 B2 11/2003 Jacoff
6,648,102 B2 * 11/2003 Bostelman ..... B63C 5/02 182/130
6,826,452 B1 * 11/2004 Holland ..... B66C 1/663 318/566
6,827,334 B2 * 12/2004 Voile et al. ..... 254/285
7,284,744 B1 * 10/2007 Lerchenmueller et al. .. 254/278
7,287,740 B2 10/2007 Reyes
7,392,914 B2 7/2008 Sorsa
7,575,214 B2 * 8/2009 Badalament ..... B44C 5/00 24/129 R
7,896,324 B2 * 3/2011 Okazaki ..... 269/17
7,918,354 B2 4/2011 Shan
8,195,368 B1 * 6/2012 Leban ..... B66C 13/063 212/277
8,402,898 B2 * 3/2013 Rodnunsky ..... B66D 3/04 104/173.1
8,646,630 B2 * 2/2014 Franzen et al. ..... 212/318
2002/0144967 A1 * 10/2002 Jacoff et al. ..... 212/274
2004/0146388 A1 * 7/2004 Khajepour et al. ..... 414/680
2005/0024004 A1 * 2/2005 Rodnunsky ..... F16M 11/42 318/649
2005/0024005 A1 * 2/2005 Rodnunsky et al. ..... 318/649
2005/0112963 A1 5/2005 Lavorata
2005/0224438 A1 10/2005 Maurer
2007/0064208 A1 * 3/2007 Giegerich et al. ..... 353/122
2007/0114505 A1 * 5/2007 Reyes et al. ..... 254/278
2008/0121601 A1 5/2008 Ehrenleitner
2009/0066100 A1 * 3/2009 Bosscher et al. ..... 294/86.4
2009/0159548 A1 7/2009 Waisanen
2013/0126457 A1 5/2013 Sturm, Jr.

FOREIGN PATENT DOCUMENTS

DE 102005030969 12/2001
DE 10245868 4/2004
EP 1524187 4/2005
FR 2085267 A1 12/1971
GB 725457 3/1955
GB 2012238 7/1979
GB 2278821 12/1994
JP 47030457 U 12/1972
JP 64013395 A 1/1989
JP 03100279 U 10/1991
JP 05019280 U 3/1993
JP H07 33384 A 2/1995
JP H07 61766 A 3/1995
JP 2004075233 A 3/2004
JP 2004155580 A 6/2004
NL 7203224 10/1972
SU 1157007 A1 5/1985
WO 8909723 10/1989
WO 2005013195 A2 2/2005
WO WO 2007/139383 12/2007
WO 2011123816 A2 10/2011

OTHER PUBLICATIONS

Ukrainian Office Action dated Jul. 7, 2014 for corresponding Ukrainian Application No. a 2012 12292, filed Apr. 1, 2011.
International Search Report and Written opinion dated Feb. 21, 2014 for International Patent application No. PCT/US2013/072314 filed on Nov. 27, 2013.
European Search Report dated Jun. 25, 2014 for European Patent Application No. 14157697, filed Apr. 1, 2011.
Japanese Office Action dated Dec. 17, 2014, for corresponding Japanese Application No. 2013-502901, filed Jun. 29, 2011.
Russian Office Action dated Feb. 24, 2015, for corresponding Russian Patent Application No. 2012146516, filed Apr. 1, 2011.
International Search Report and Written Opinion of corresponding foreign application PCT/US2013/060941, filed Sep. 20, 2013.
Office Action for U.S. Appl. No. 14/032,862, dated May 21, 2015.
Final Office Action for U.S. Appl. No. 14/032,862, dated Feb. 9, 2016.
Office Action for U.S. Appl. No. 14/032,862, dated Oct. 5, 2016.
Response to Office Action for U.S. Appl. No. 14/032,862, dated Jan. 5, 2017.
Response to Office Action for U.S. Appl. No. 14/032,862, dated Nov. 23, 2015.

* cited by examiner

TENSILE TRUSS MAST

REFERENCE TO RELATED CASES

The present application is based on and claims the benefit of U.S. provisional patent application Ser. No. 61/320,094, filed Apr. 1, 2010, Ser. No. 61/356,254, filed Jun. 18, 2010, and Ser. No. 61/369,165, filed Jul. 30, 2010, the content of all of these documents being hereby incorporated by reference in its entirety.

BACKGROUND

The discussion below is merely provided for general background information and is not intended to be used as an aid in determining the claimed subject matter.

Moveable platform systems suspended by cables are known. In one embodiment, an upper platform mounted to, for example, a bridge supports a lower platform using six wire ropes. Both the upper platform and the lower platform each have three spaced apart locations where two wire ropes are joined or come together such that the wire ropes at each location come from two different locations on the other platform. A stable lower platform is obtained because the wire ropes are kinematically constrained and where the stiffness of the platform is determined, at least in part, by the tensile elasticity of the wire ropes. The lower platform can be moved in a work envelope as determined by the length of each of the wire ropes suspending the lower platform from the upper platform as well as the linear position of the upper platform on the bridge, if the upper platform is moveable on the bridge in one degree of linear motion, and/or the bridge is movable on gantry rails in another degree of linear motion.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

Aspects of the disclosure relate to hoist systems. In one embodiment, a hoist system includes an upper platform that has a plurality of rotatable support arms. The plurality of rotatable support arms are connected to a lower platform utilizing a plurality of flexible members. A plurality of hoists extends and retracts the plurality of flexible members.

In another embodiment, a hoist system includes an upper platform that has a plurality of adjustable length support arms. The plurality of adjustable length support arms are connected to a lower platform utilizing a plurality of flexible members. A plurality of hoists extends and retracts the plurality of flexible members.

In yet another embodiment, a hoist system includes a lower platform, an upper platform, and a plurality of extendable and retractable flexible members. The lower platform has a first set of pulleys and a second set of pulleys, and the upper platform has a plurality of support arms. Each flexible member is guided by one of the first set of pulleys and one of the second set of pulleys so as to form a couple when the corresponding flexible member is in tension. A plurality of hoists extends and retracts the plurality of flexible members.

Furthermore, any of the embodiments described herein may include a plurality of sensors to configured to measure position, stress, strain, tension or other parameters of the system such as described below, and/or a controller to receive signals from such sensors.

Additionally, any of the embodiments described above may include one or more of the following features. The support arms may be rotatable about a vertical axis. The support arms can be extendable and retractable with respect to a vertical axis. The hoists may be disposed at an end of the support arms. Each of the support arms may include a sheave or pulley that guides one of the flexible members to the lower platform, and each of the hoists may be disposed remote from the ends of the support arms. A trolley can be included that supports the upper platform for rotation thereon, and a plurality of actuators can be included that are configured to extend and retract the plurality of support arms together or individually to position the lower platform where desired.

Besides extending and retracting the support arms so as to position the lower platform where desired, it should also be noted that extension and retraction of the support arms can be controlled for other purposes. For instance, stiffness of the upper platform with the support arms retracted is typically greater than when the support arms are extended, for example, when lifting loads vertically. Relative stiffness of the upper platform, or of the system as a whole, can be determined or calculated and stored, for example, in computer memory. When it is desired to lift a load, or otherwise move a load within the work envelope with a desired amount of stiffness, such inputs can be provided to the system, for example, through a computer interface or the like wherein the system then extends or retracts the support arms in order to obtain the desired stiffness.

Another example of automatic extension or retraction of the support arms occurs when it is desired to move the lower platform to the uppermost reaches of the work envelope, (i.e. as close to the upper platform as possible). In order to achieve this position, it is advantageous to retract the support arms in order to control the angles of the wire ropes, for example, relative to the rotational axis of the upper platform.

In some embodiments, hoist systems may include a system for ascertaining elongation of the wire rope(s) due to the load on the lower platform. In this manner, compensation can be provided so as to position the lower platform in a selected position, compensating for elongation in the wire rope(s), compensating for slack in the wire rope(s) and/or other external forces applied to the lower platform and/or wire ropes(s) in one, some or all degrees of freedom. In one embodiment, elongation or slack of a wire rope is measured directly with a sensor or sensors, for example, where the sensors are operably coupled between the upper platform and the lower platform along one, some or all of the wire ropes. Referring to FIG. 1, such a sensor(s) can comprise a transmitter disposed on one of the platforms, for instance at, with a receiver disposed on the other platform. The sensor(s) throughout the system can be mechanically, electrically and/or optically based, hard-wired or wireless.

Alternatively, or in addition, elongation of the wire rope can be ascertained by the amount of tension in the wire rope(s). Tension in the wire rope(s) can be measured using a load cell operably coupled to the wire rope to sense tension therein. For instance, the load cell can couple an end of the wire rope to the lower platform. In another embodiment, a load cell can be incorporated in the mount for each hoist. In yet another embodiment, tension can be inferred through the work performed by the hoist(s) for example by sensing characteristics of the power needed to operate the hoist such as the current for an electrical motor used to rotate a drum of the hoist, or fluid flow characteristics for a hydraulic or pneumatically powered hoist.

The system can null out the effects of elongation of the wire rope(s) in order to accurately position the lower platform as desired. However, in addition, the system can also null out any other forms of deflection that may occur due to deflections or the like in other components such as but not limited to support arms, upper platform, lower platform, bridges, rails or components thereof to name just a few. Sensor(s) can be configured to provide signal(s) corresponding to deflections of one or more of these components. For instance, such deflections can be measured by displacement sensors, strain gauges to name just a few.

Movement of the lower platform to desired locations can be performed manually where the operator is given independent control of all hoist motors and/or drive motors to rotate the upper platform. Typically, the operator is provided with a user interface having one or more joysticks or other control mechanism where movements thereof are translated so as to operate the hoist motors and/or drive motors to cause movement of the upper platform or carriage either directly through rotation thereof, movement of its trolley, and/or movement of a bridge supporting the carriage, if one is provided. Depending upon the location of the lower platform relative to any obstacles in structure such as the enclosure walls, the system can be programmed so as to automatically extend or retract one or more of the support arms/or rotate the upper platform in order to avoid contact of the wire ropes and/or the lower platform with the enclosure or other obstacles. The work envelope and any potential obstacles can be defined in computer memory wherein the position of the lower platform, wire ropes and/or upper platform/carriage can be tracked virtually in order to avoid contact with obstacles such as the enclosure walls. If desired, sensors can also be mounted to any of the components in the system such as the upper platform, lower platform, support arms and/or mechanisms coupled to the lower platform. Such sensors can be proximity sensors so as to sense contact or possible contact of components of the system with obstacles and/or otherwise control the system to avoid such obstacles. In one embodiment, a system controller receives inputs from some or all of the sensors described above, command signals from the user interface and provides control signals to hoists, actuators, drive(s) to rotate the upper platform, drive(s) to move the trolley on a bridge or truss, and/or drive(s) to move the bridge on rails.

As indicated above, in addition or in the alternative to monitoring elongation of wire rope(s), the sensors to directly or indirectly sense tension in the wire rope(s) can be configured so as to detect slack such as but not limited to if the lower platform were to encounter an obstacle. If slack is detected in one or more wire ropes via the sensor(s), the system controller can be configured to provide an alarm and/or automatically operate the appropriate hoist(s) until proper tension is obtained. If desired, the system controller can be further configured to prevent other motions of the lower platform, which can include preventing further operation of the hoists, drive(s), the drive mechanisms for the support arms (e.g. actuators), drive(s) for the trolley and/or drive(s) for a bridge on rails, the bridge supporting the trolley.

Some other features that may be present in any of the embodiments include the following. Each of the flexible members can utilize at least one pulley on the lower platform and have an attachment point on one of the plurality of support arms. Each of the flexible members can extend from one of the plurality of support arms and have an attachment point that is either on the same one of the plurality of support arms or on a different one of the plurality of support arms. Each of the flexible members may utilize two or more pulleys on the lower platform. A portion of each flexible member of each couple between the corresponding pulleys of the couple may extend along a line that is parallel to or in the plane of the lower platform. Alternatively or in addition, a portion of each flexible member of each couple between the corresponding pulleys of the couple may intersect with the plane of the lower platform.

If desired, a weighted collar can be included that is suspended from the upper platform and that supports a spine extending from the lower platform. A spine extending from the lower platform may have a shape that is keyed to a shape of an aperture in the weighted collar.

Finally, for illustration purposes only and not by limitation, any of the embodiments described above may include one or more of the following features. A remote end of each flexible member may be secured so as to form two spaced apart portions that are in tension. Both the upper platform and the lower platform can have at least three spaced apart locations where at least two flexible members are disposed such that the flexible members at each location come from at least two different locations on the other platform. Both the upper platform and the lower platform can have three spaced apart locations where two flexible members are disposed such that the flexible members at each location come from two different locations on the other platform. The plurality of hoists and the plurality of flexible members can each comprise three. The plurality of hoists and the plurality of flexible members can each comprise six. A plurality of pulleys can be included and mounted to one of the platforms, and each flexible member can be guided by at least one of the pulleys so as to form two spaced apart portions of each flexible member in tension extending between the upper and lower platforms. A reel system can be included that is configured to extend and retract lines between the upper and lower platforms.

Other aspects of the invention include methods of operating a hoist system as herein described with one or more of the features herein described.

These and various other features and advantages that characterize the claimed embodiments will become apparent upon reading the following detailed description and upon reviewing the associated drawings.

DETAILED DESCRIPTION OF ILLUSTRATIVE EMBODIMENTS

The embodiments described below and illustrated in the accompanying figures describe various inventive aspects for hoist systems. Although these aspects may be described and illustrated with respect to certain embodiments, it should be understood that these aspects can be combined in any manner or used alone in such hoist systems as desired and should not be limited to the specific embodiments herein provided.

Figure 1:
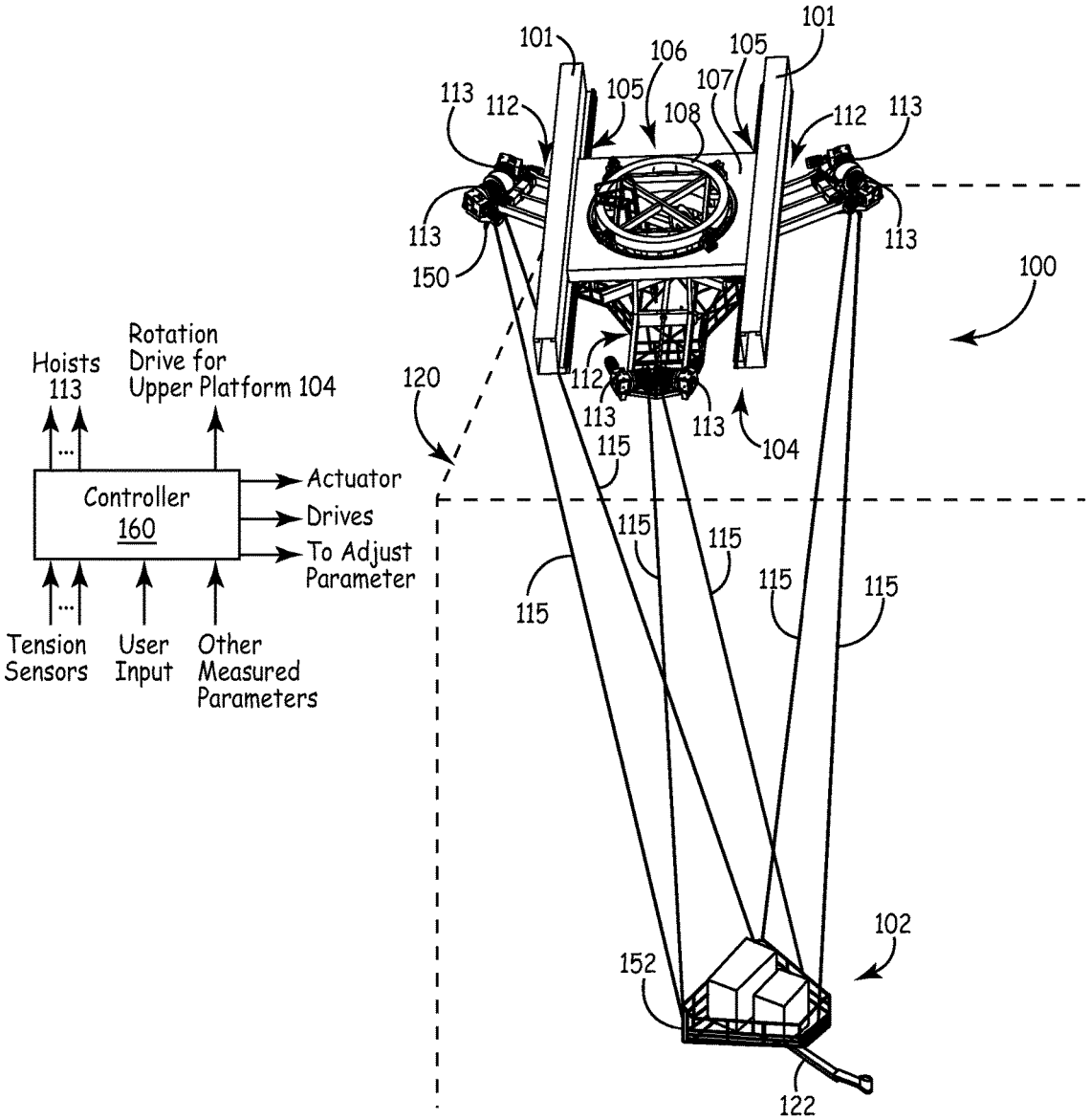
FIG. 1 is a perspective view of a hoist system having retractable support arms.

FIG. 1 illustrates one example of a hoist system 100 for selectively moving a lower platform 102 (e.g. a tool platform) in a selected work envelope. The hoist system 100 includes an upper platform 104 that can be mounted to a support structure 101. For instance, the support structure 101 can be a fixed truss, a bridge, or one or more rails. If desired, the upper platform 104 can be mounted to a trolley 105 with suitable drives for movement on the support structure 101. Likewise, the support structure 101 can be part of a gantry system and be movable on rails thereof with suitable drives. However, the support structure 101 is not pertinent for the understanding of the inventive aspects herein described, and thus, will not be further elaborated.

Figure 2:
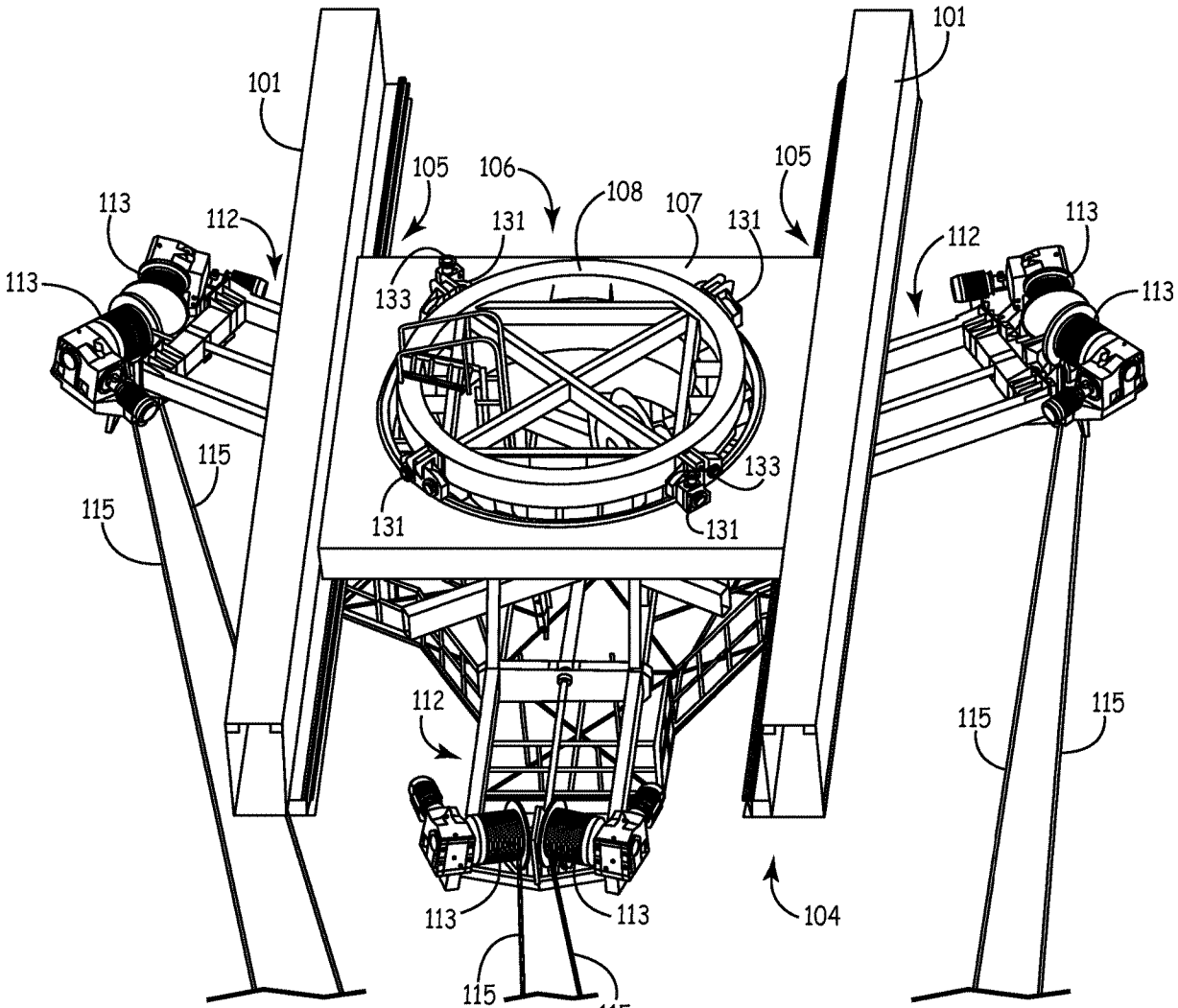
FIG. 2 is a perspective view of an upper platform of a hoist system having retractable support arms.

FIG. 2 is a more detailed view of the upper platform 104 shown in FIG. 1. The upper platform 104 optionally includes two advantageous features that can be provided separately or in combination as desired. In particular as illustrated by the exemplary embodiment in FIG. 2, the upper platform 104 includes a carriage 106 having a support structure or platform 108 that can rotate relative to a second portion 107 of the carriage 106, which can be fixedly mounted to trolley 105, or otherwise supported by the support structure 101 described above. As a second aspect, the carriage 106 herein illustrated may also include extendable arms 112. Each arm 112 typically supports a plurality of hoists 113, for example two as illustrated, although more or less can be provided if desired. Additionally, although the specific examples of hoist system shown in the figures either have three support arms 112 (e.g. FIGS. 1-13) or four support arms 112 (e.g. FIG. 19), it should be understood that embodiments of hoist systems may include more or less than the illustrated three or four support arms 112 and that each support arm 112 can be provided with corresponding hoists, cabling and pulleys as desired.

The upper platform 104 supports the lower platform 102 (shown and labeled in FIG. 1) via a plurality of flexible members 115 such as wire ropes. Each of the wire ropes 115 is adjustable in length via a hoist 113. In the embodiment illustrated in FIGS. 1-2, the hoists 113 are carried by the upper platform 104, which can be advantageous; however, the hoists 113 could be provided on the lower platform 102 in the alternative, or in combination with the hoists 113 on the upper platform 104. In one embodiment, both the upper platform 104 and the lower platform 102 each have three spaced apart locations where two wire ropes 115 are joined or come together such that the wire ropes 115 at each location come from two different locations on the other platform.

The carriage 106 of the upper platform 104 optionally has trolleys 105 that slide linearly in the support structure 101. This allows the upper platform 104 to be able to move relative to the support structure 101. Additionally, the support platform 108 of the carriage 106 can be rotatable relative to portion 107 of the carriage 106 using rollers, bearings, guide surfaces or the like. Bearings can include fluid films (e.g. air or liquid) if desired. Likewise, magnetic bearings may also be employed. In the embodiment illustrated, rollers or wheel assemblies 131 are provided and fixed relative to one portion of the carriage, herein portion 107, while the rollers or wheels of assemblies 131 engage a surface(s) of the support platform 108. One or more drive motors 133 are illustratively provided for the wheel assemblies 131. Again, this embodiment is merely exemplary.

The foregoing features taken alone or in combination may advantageously increase a work envelope of the lower platform 102. For instance, referring back to FIG. 1, the hoist system 100 can be used to position the lower platform 102 within a large structure 120. In the exemplary application illustrated, the lower platform 102 supports a multi-degree of freedom arm 122 which can reach and grab objects within the structure 120. Rotation of the upper platform 104 and/or adjusting the lengths of the support arms 112, separately or in combination, and with also adjusting the lengths of the wire ropes 115, separately or in combination, allows the position of the lower platform 102 to be adjusted such that the arm 122 can reach all desired locations within the structure 120.

Figure 3:
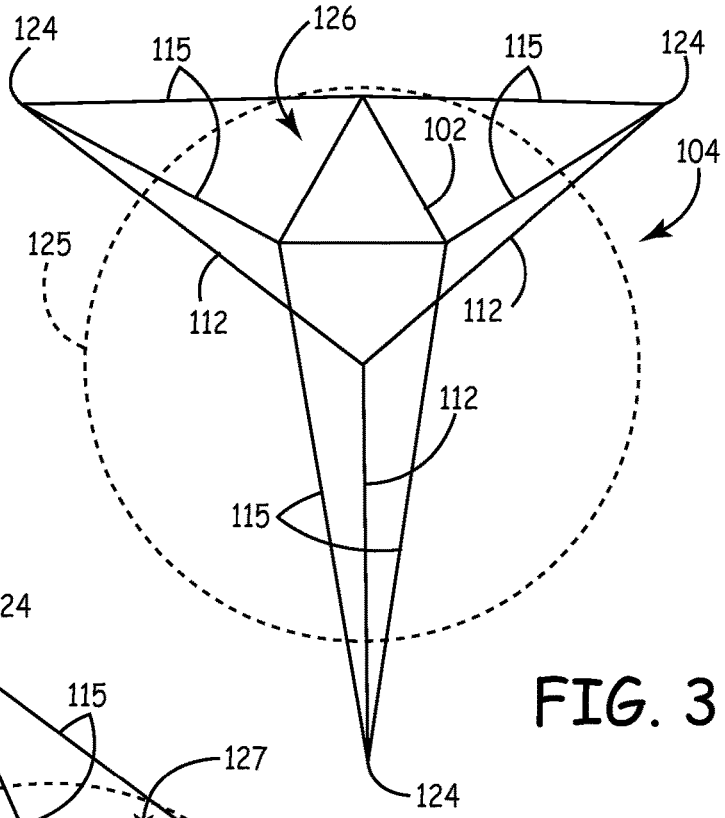
FIGS. 3-4 are top down schematic diagrams illustrating movement of a lower platform relative to an upper platform.
Figure 4:
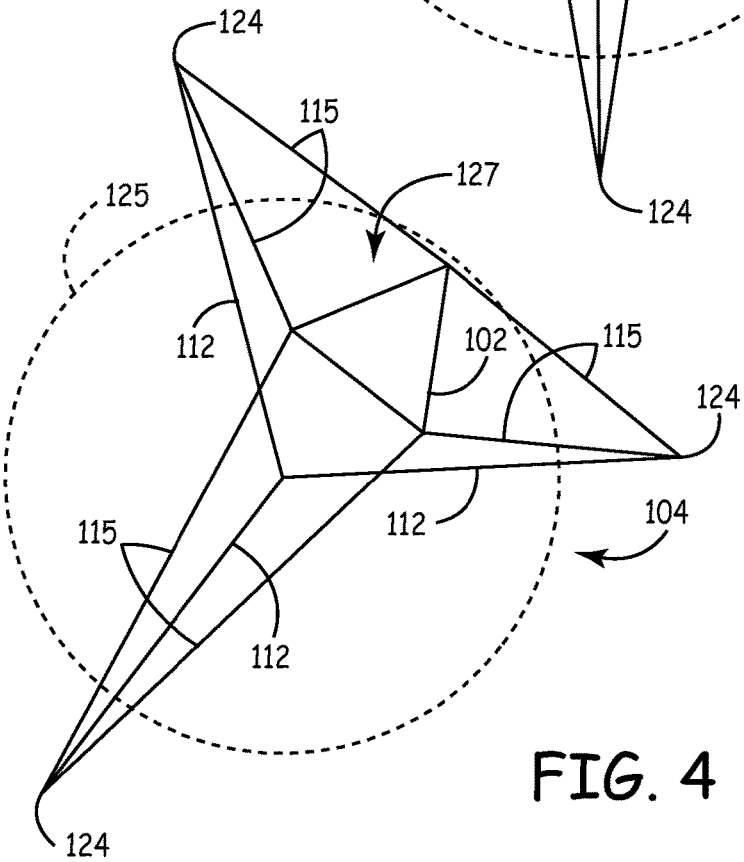

FIGS. 3 and 4 schematically illustrate movement of the lower platform 102 relative to the upper platform 104 (as represented by support arms 112) in a work envelope 125. In these figures, the hoists 113 for the wire ropes 115 are not explicitly illustrated, but are instead represented by points 124. It should be noted in FIGS. 3 and 4 that the locations of points 124 are not fixed; hence additional positions of the lower platform 102 relative to the upper platform 104, although not shown in these figures, can be obtained by adjusting the length of one or more of the support arms 112. FIG. 3 illustrates a first position 126 for lower platform 102, while a second position 127 for lower platform 102 is illustrated in FIG. 4, although through manipulation of components such as the hoists or rotation of the upper platform 104 the lower platform 102 can be positioned anywhere in the work envelope 125, which of course can be three dimensional and not limited to the two dimensional representation herein illustrated. FIGS. 3 and 4 specifically illustrate how the lower platform 102 can be moved from position 126 to position 127 through a rotation of the upper platform 104.

Figure 5:
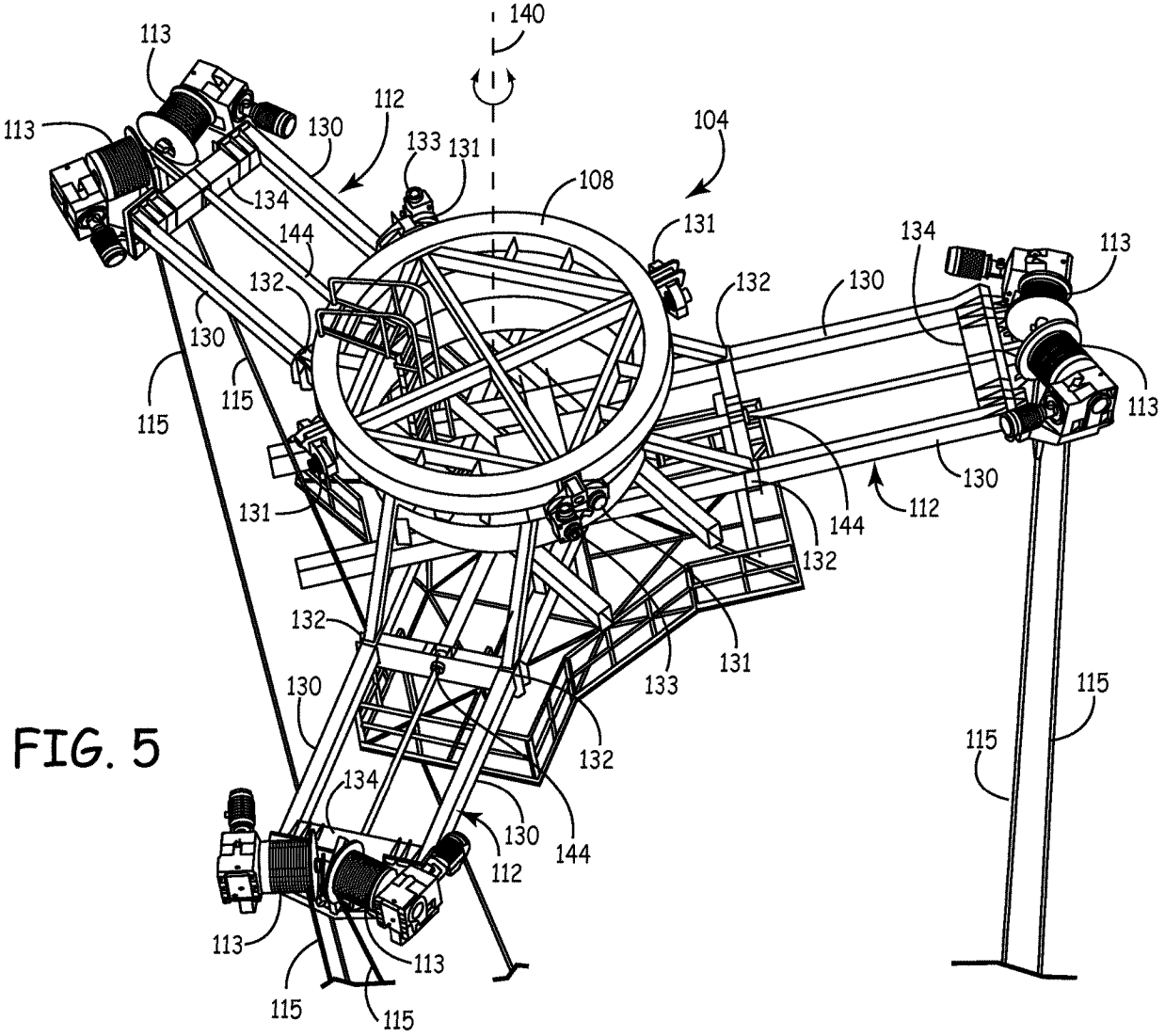
FIG. 5 is a perspective view of an upper platform of a hoist system having retractable arms with the rails removed.

FIG. 5 illustrates an embodiment of the upper platform 104 of FIGS. 1-2 with the support structure 101 and portions of the carriage 106 removed to better show some of the features optionally included within an upper platform 104. As can be seen in FIG. 5, each support arm 112 illustratively includes parallel rails 130 having first ends (inside receivers 132) and second ends that are coupled together to provide a support 134 for the hoist(s) 113. Each rail 130 is received in a corresponding tubular receiver 132, which like the rails 130 are organized in parallel pairs. The rails 130 may be fixedly coupled and/or stacked to the support platform 108, or the rails 130 and the support platform 108 can be constructed such that the rails 130 form a portion of the support platform 108 (e.g. the rails 130 and the support platform 108 are constructed as one integrated unit (i.e. formed from a single unitary body). The receivers 132 are optionally arranged such that the sets of rails 130 are positioned at 120° intervals about a rotational axis 140 of the upper platform 104. In the embodiment illustrated, a drive mechanism such as an actuator 144 is operably coupled to the rails 130 and the receivers 132 such that extension and retraction of the actuator 144 causes corresponding extension and retraction of the support arms 112 and hoists 113 on the upper platform 104. The actuators 144 can comprise hydraulic, pneumatic and/or electric actuators. However, as appreciated by those skilled in the art, other drive mechanisms can be used such as but not limited to ball and screw drives, cables and pulleys, and pinion and rack assemblies to name just a few.

Besides extending and retracting the support arms 112 so as to position the lower platform 102 where desired, it should also be noted that extension and retraction of the support arms 112 can be controlled for other purposes. For instance, stiffness of the upper platform 104 with the support arms 112 retracted is typically greater than when the support arms 112 are extended, for example, when lifting loads vertically. Relative stiffness of the upper platform 104, or of the system as a whole, can be determined or calculated and stored, for example, in computer memory. When it is desired to lift a load, or otherwise move a load within the work envelope with a desired amount of stiffness, such inputs can be provided to the system, for example, through a computer interface or the like wherein the system then extends or retracts the support arms 112 in order to obtain the desired stiffness.

Another example of automatic extension or retraction of the support arms 112 occurs when it is desired to move the lower platform 102 (shown and labeled in FIG. 1) to the uppermost reaches of the work envelope, (i.e. as close to the upper platform 104 as possible). In order to achieve this position, it is advantageous to retract the support arms 112 in order to control the angles of the wire ropes 115, for example, relative to the rotational axis 140 of the upper platform 104.

Figure 6:
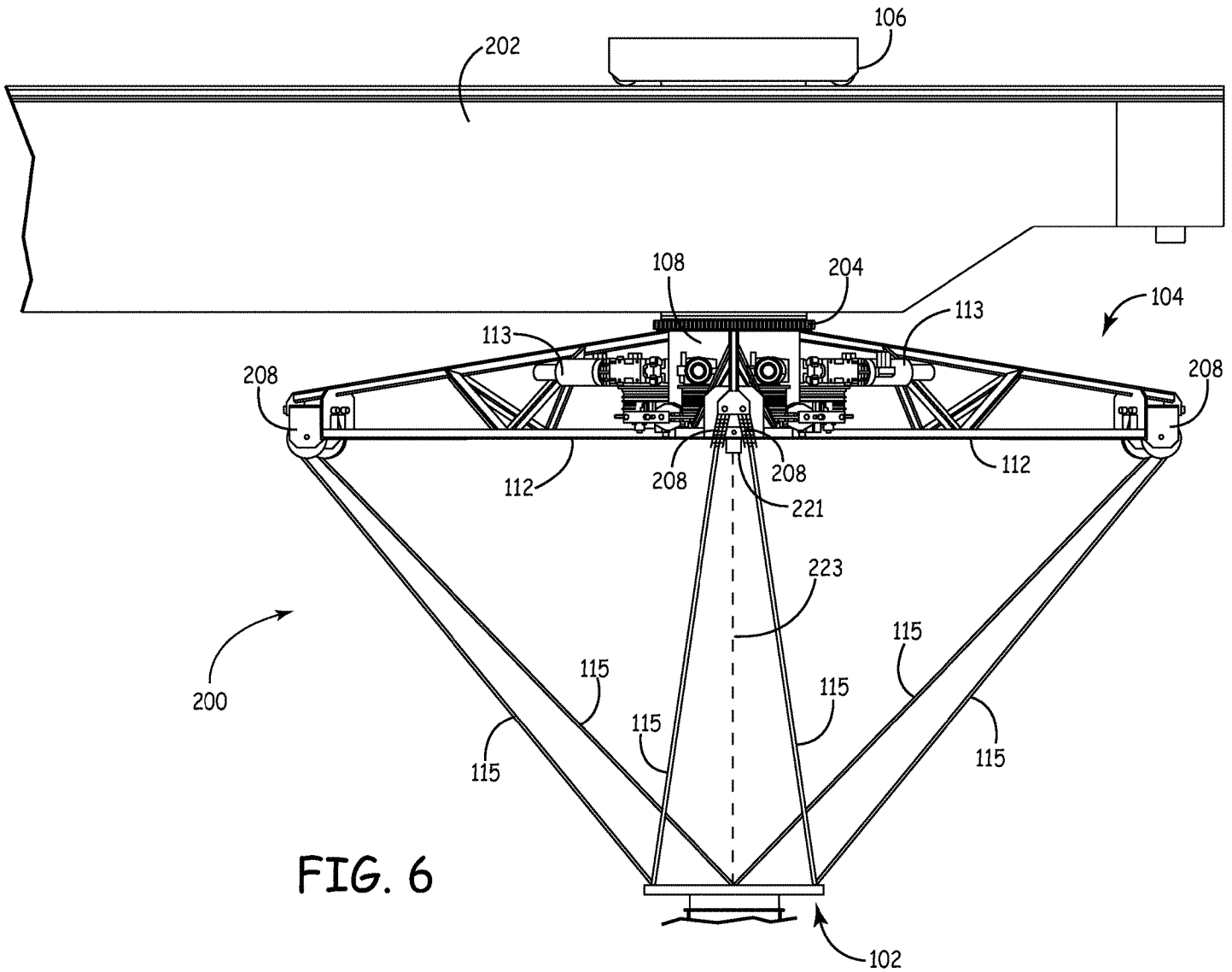
FIG. 6 is a side view of a hoist system having fixed length support arms.
Figure 7:
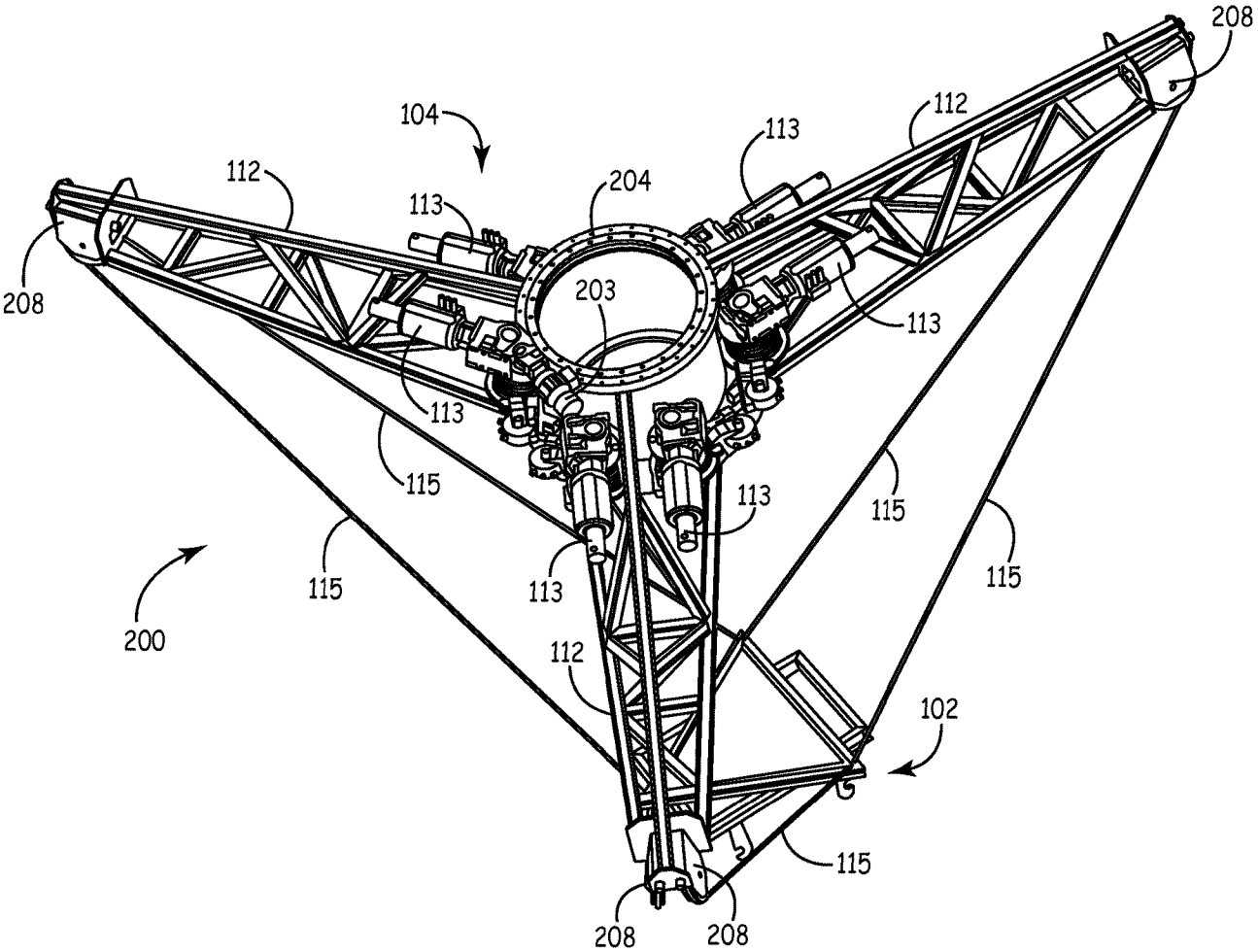
FIG. 7 is a perspective view of a hoist system having fixed length support arms.
Figure 8:
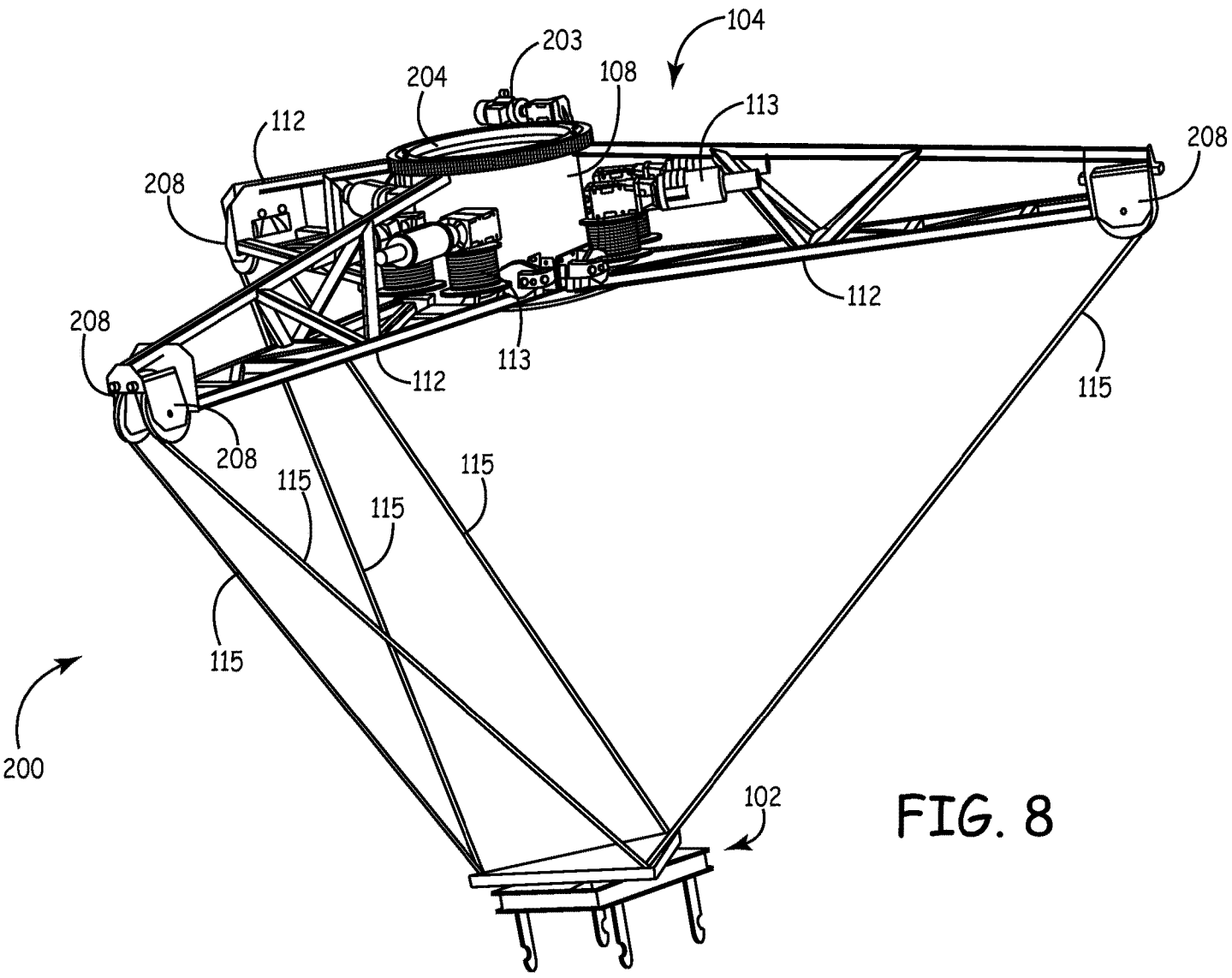
FIG. 8 is a perspective view of a hoist system having fixed length support arms.

FIGS. 6-8 illustrate another embodiment of a hoist system at 200. The same reference numbers have been used in this embodiment to identify those components that have the same or similar function as in the previous embodiment. FIG. 6 is a side view of the hoist system 200. In some embodiments, such as in the one shown in the FIG. 7, carriage 106 is moveable on rails 202. Carriage 106 includes the support platform 108 which again is rotatable. To rotate the platform 108, a pinion drive and motor 203 (shown and labeled in FIG. 8) is provided to engage a gear ring member 204. Support arms 112 in this embodiment are not adjustable in length. In one embodiment, hoists 113 are mounted inwardly near the center of the platform 108 where sheaves 208 at the end of the support arms 112 guide the wire ropes 115. FIG. 6 also illustrates an optional reel system 221 that includes electric, optical, hydraulic and/or pneumatic lines 223 extending from the upper platform 104 to the lower platform 102. The reel system 221 includes line drive assembly including a spring, counterweight and/or drive mechanism (hydraulic, pneumatic or electric) to extend and retract the line(s) 223 while maintaining appropriate tension therein as the lower platform is raised and lowered.

FIG. 7 is a top down view of the hoist system 200. In FIG. 7, the rails 202 and some portions of the carriage 106 have been removed to better show some of the features optionally included within the hoist system 200. As can be seen in the figure, the hoist system 200 illustratively includes three support arms 112 that are spaced at approximately 120° intervals from each other. Additionally, each support arm 112 has two corresponding hoists 113 and sheaves 208 that are utilized to support and control the length of two wire ropes 115. Embodiments of hoist systems are not however limited to any particular configuration and may include more or less support arms 112, hoists 113, sheaves 208, and wire ropes 115 than what is shown in the particular embodiment illustrated in FIGS. 6-8.

FIG. 8 is a side perspective view of the hoist system 200. Again, like in FIG. 7, the rails 202 and some portions of the carriage 106 have been removed to better show some of the features optionally included within the hoist system 200. For instance, FIG. 8 shows one example of a pinion drive and motor 203 that functionally engages a gear ring member 204. The combination of pinion drive and motor 203 and ring member 204 are illustratively utilized in rotating the support platform 108 including the support arms 112 and the wire ropes 115. Accordingly, the rotation of the platform 108 and any attached support arms 112 can be used to control the position of the lower platform 102.

In some embodiments, hoist systems may include a system for ascertaining elongation of the wire rope(s) 115 due to the load on the lower platform 102. In this manner, compensation can be provided so as to position the lower platform 102 in a selected position, compensating for elongation in the wire rope(s) 115, compensating for slack in the wire rope(s) 115 and/or other external forces applied to the lower platform 102 and/or wire ropes(s) 115 in one, some or all degrees of freedom. In one embodiment, elongation or slack of a wire rope is measured directly with a sensor or sensors, for example, where the sensors are operably coupled between the upper platform 104 and the lower platform 102 along one, some or all of the wire ropes 115. Referring to FIG. 1, such a sensor(s) can comprise a transmitter disposed on one of the platforms, for instance at 150, with a receiver 152 disposed on the other platform. The sensor(s) can be mechanically, electrically and/or optically based, hard-wired or wireless.

Alternatively, or in addition, elongation of the wire rope can be ascertained by the amount of tension in the wire rope(s) 115. Tension in the wire rope(s) 115 can be measured using a load cell operably coupled to the wire rope 115 to sense tension therein. For instance, the load cell can couple an end of the wire rope 115 to the lower platform 102 again at 152. In another embodiment, a load cell can be incorporated in the mount for each hoist 113. In yet another embodiment, tension can be inferred through the work performed by the hoist(s) 113 for example by sensing characteristics of the power needed to operate the hoist such as the current for an electrical motor used to rotate a drum of the hoist, or fluid flow characteristics for a hydraulic or pneumatically powered hoist.

The system can null out the effects of elongation of the wire rope(s) 115 in order to accurately position the lower platform 102 as desired. However, in addition, the system can also null out any other forms of deflection that may occur due to deflections or the like in other components such as but not limited to support arms 112, upper platform 104, lower platform 102, bridges, rails or components thereof to name just a few. Sensor(s) can be configured to provide signal(s) corresponding to deflections of one or more of these components. For instance, such deflections can be measured by displacement sensors, strain gauges to name just a few.

Movement of the lower platform 102 to desired locations can be performed manually where the operator is given independent control of all hoist motors and/or drive motors to rotate the upper platform. Typically, the operator is provided with a user interface having one or more joysticks or other control mechanism where movements thereof are translated so as to operate the hoist motors 113 and/or drive motors to cause movement of the upper platform 104 or carriage 106 either directly through rotation thereof, movement of its trolley, and/or movement of a bridge supporting the carriage 106, if one is provided. Depending upon the location of the lower platform 102 relative to any obstacles in structure 120 such as the enclosure walls, the system can be programmed so as to automatically extend or retract one or more of the support arms 112 and/or rotate the upper platform 104 in order to avoid contact of the wire ropes 115 and/or the lower platform 102 with the enclosure 120 or other obstacles. The work envelope and any potential obstacles can be defined in computer memory wherein the position of the lower platform 102, wire ropes 115 and/or upper platform 104/carriage 106 can be tracked virtually in order to avoid contact with obstacles such as the enclosure walls. If desired, sensors can also be mounted to any of the components in the system such as the upper platform 104, lower platform 102, support arms 112 and/or mechanisms coupled to the lower platform 102. Such sensors can be proximity sensors so as to sense contact or possible contact of components of the system with obstacles and/or otherwise control the system to avoid such obstacles. In one embodiment, a system controller 160 (shown and labeled in FIG. 1) receives inputs from some or all of the sensors described above, command signals from the user interface and provides control signals to hoists 113, actuators 144, drive(s) 133 to rotate the upper platform 104, drive(s) to move the trolley 105 on a bridge or truss, and/or drive(s) to move the bridge on rails.

As indicated above, in addition or in the alternative to monitoring elongation of wire rope(s) 115, the sensors to directly or indirectly sense tension in the wire rope(s) 115 can be configured so as to detect slack such as but not limited to if the lower platform 102 were to encounter an obstacle. If slack is detected in one or more wire ropes 115 via the sensor(s), the system controller 160 can be configured to provide an alarm and/or automatically operate the appropriate hoist(s) 113 until proper tension is obtained. If desired, the system controller 160 can be further configured to prevent other motions of the lower platform 102, which can include preventing further operation of the hoists 113, drive(s) 133, the drive mechanisms for the support arms 112 (e.g. actuators 144), drive(s) for the trolley 105 and/or drive(s) for a bridge on rails, the bridge supporting the trolley 105.

Figure 9:
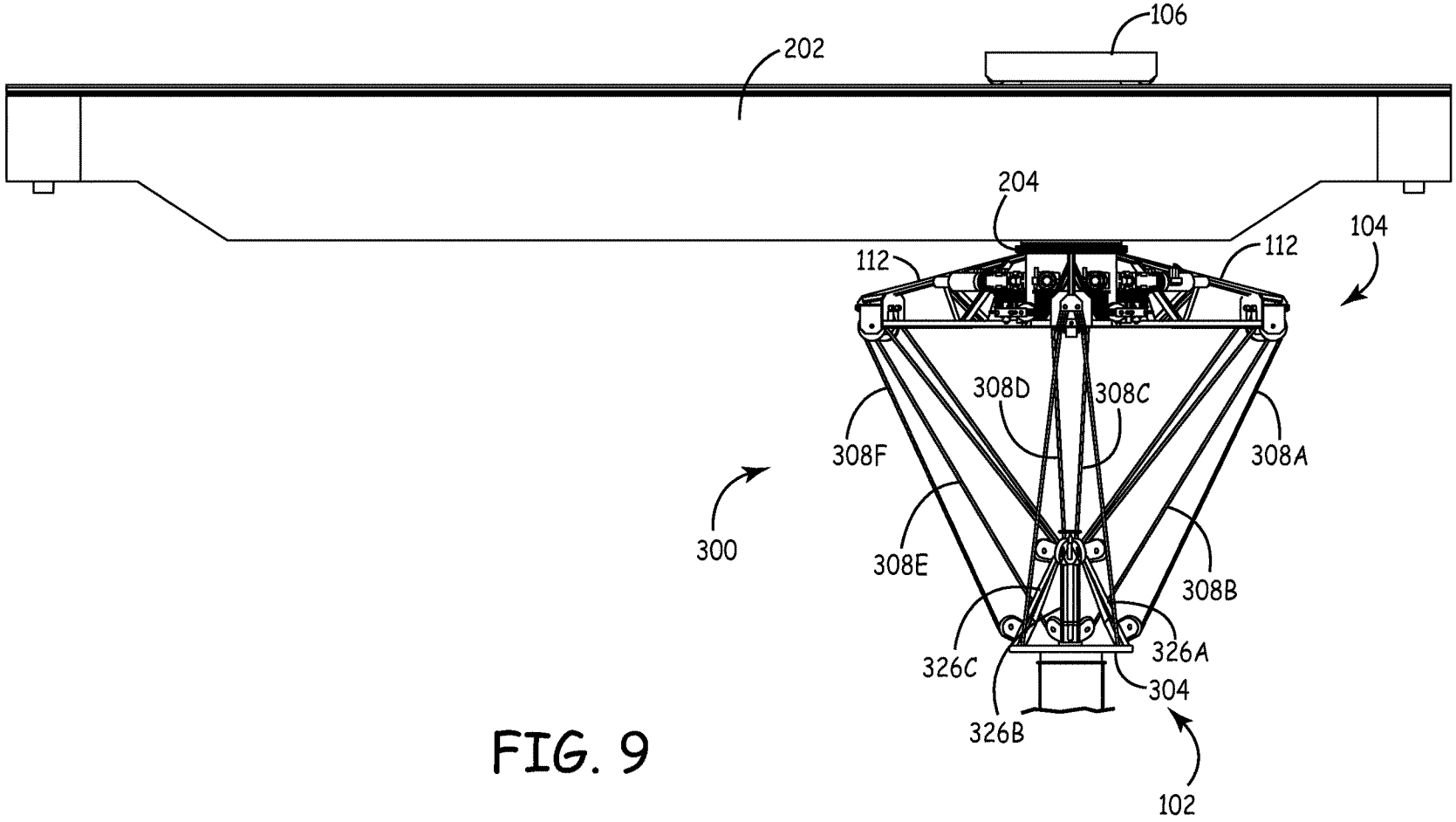
FIG. 9 is a side view of a hoist system having a two part cabling system.

FIGS. 9-16 illustrate yet another embodiment, or aspects thereof, of a hoist system at 300. The same reference numbers have been used in this embodiment to identify those components that have the same or similar function as the previous embodiments. FIG. 9 is a side view of the hoist system 300. In the embodiment shown in the figure, carriage 106 is moveable on rails 202. Carriage 106 includes upper platform 104 which again is rotatable herein in a manner similar to the hoist system 200 described above; however, the manner in which the upper platform 104 is rotatable should not be considered limiting in that other mechanisms can be used such as in the hoist system 100 described above. Furthermore, although illustrated wherein the upper platform 104 is rotatable, aspects of the hoist system 300 can be used in hoist systems which do no rotate.

Figure 10:
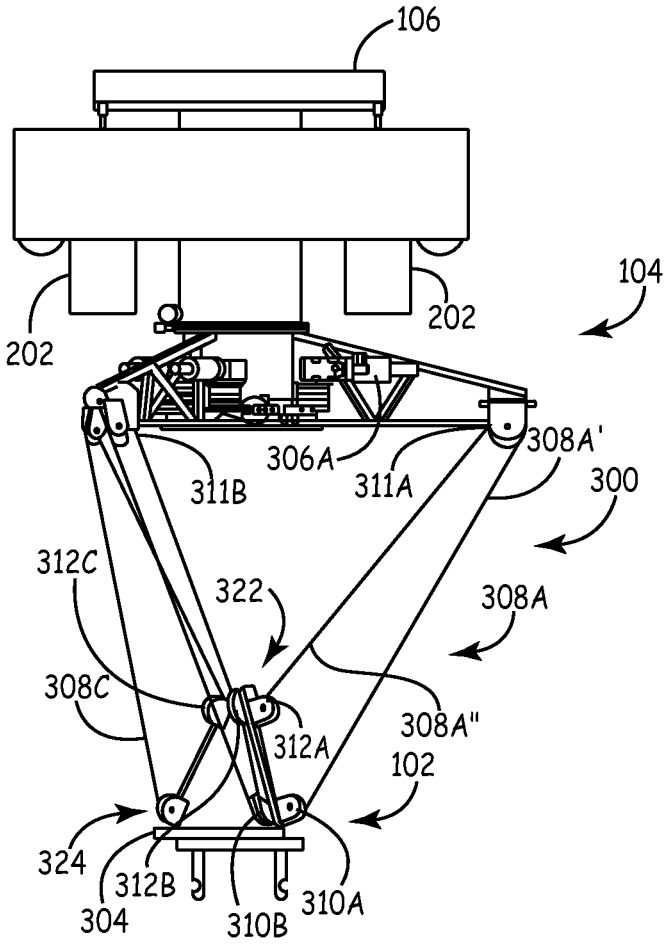
FIG. 10 is a front view of a hoist system having a two part cabling system.

FIG. 10 is a front view of the hoist system 300. As can be seen in the figure, one aspect exemplified by the hoist system 300 is the use of a plurality or a set of "2-part" cabling for control of the lower platform 102, while a second aspect is use of a spine assembly 304 on the lower platform 102. As used herein, a 2-part cabling includes a hoist such as hoist 306A (mounted for example to the upper platform 104) and a wire rope 308A from the hoist 306A that extends to at least one pulley (in this embodiment two pulleys 310A and 312A), herein provided on the lower platform 102, where a remote end of the wire rope 308A is attached back to the platform supporting the hoist 306A at a location 311A. As such, the wire rope 308A essentially comprises two portions 308A' and 308A" in tension supporting the lower platform 102. Although illustrated where the hoist 306A is mounted to the upper platform 104, and the pulleys 310A and 312A are mounted to the lower platform 102, it should be understood that this is but one embodiment wherein the location of these elements can be reversed, if desired.

Figure 11:
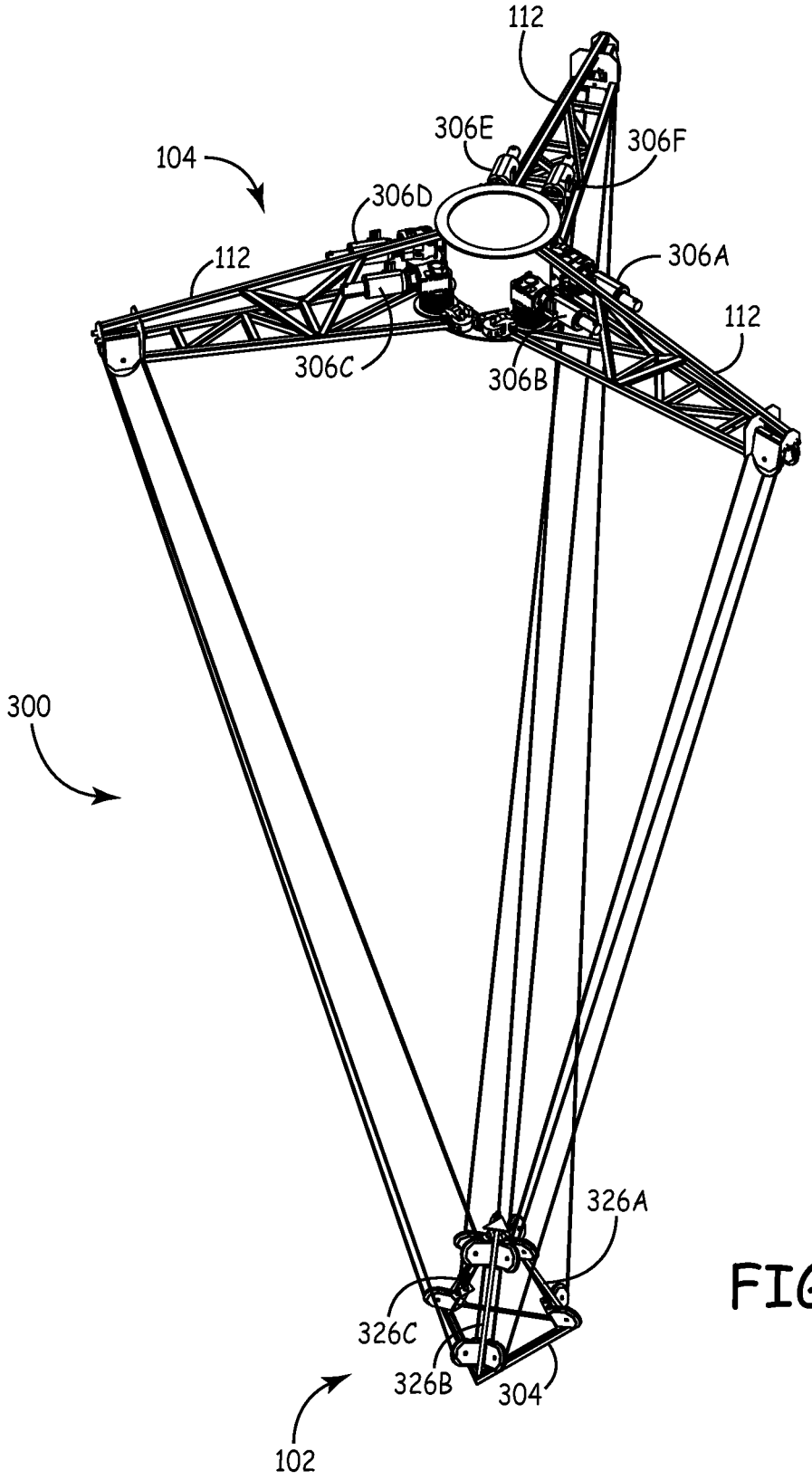
FIG. 11 is a perspective view of a hoist system having a two part cabling system.

FIG. 11 is a perspective view of the hoist system 300 with rails 202 removed. FIG. 11 shows that the hoist system 300 optionally includes six hoists, two for each of the support arms 112. Using the reference numbers above, the components of each of the 2-part hoist/wire rope assemblies are identified with letters "A", "B", "C", "D", "E" and "F". In this embodiment, each of the support arms 112 includes a pulley (e.g. 314A) at a remote end of the support arm 112 so that the corresponding hoist (e.g. 306A) can be located inwardly on the platform 108.

Figure 12:
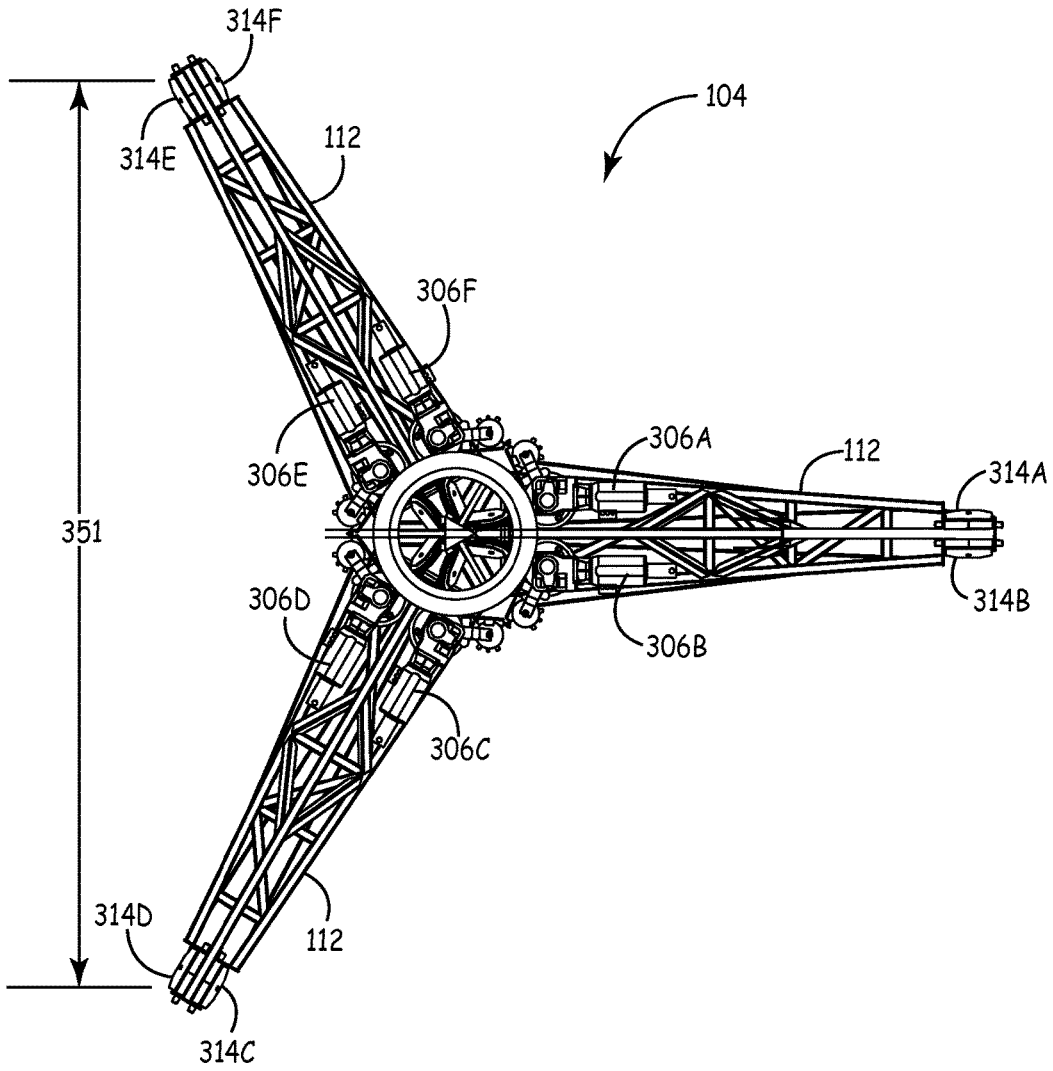
FIG. 12 is a top down view of a hoist system having a two part cabling system.

FIG. 12 is a top down view of the upper platform 104 of hoist system 300. FIG. 12 shows that each hoist 306A, 306B, 306C, 306D, 306E, and 306F has a corresponding pulley 314A, 314B, 314C, 314D, 314E, and 314F, respectively. In one embodiment, as mentioned previously, the hoists 306A-F are located inwardly along the support arms 112, and the corresponding pulleys 314A-F are located at or near the remote ends of the support arms 112. Embodiments are not however limited to the specific example shown and may include more or less than the illustrated three support arms 112, six hoists 306A-F, and six pulleys 314A-F. Additionally, the positioning of the support arms 112, the hoists 306A-F, and the pulleys 314A-F may be altered from that shown in the figure. For instance, the support arms 112 could be positioned at intervals other than 120° apart, or the hoists 306A-F could be mounted closer to or further away from the center of the platform 104.

Figure 13:
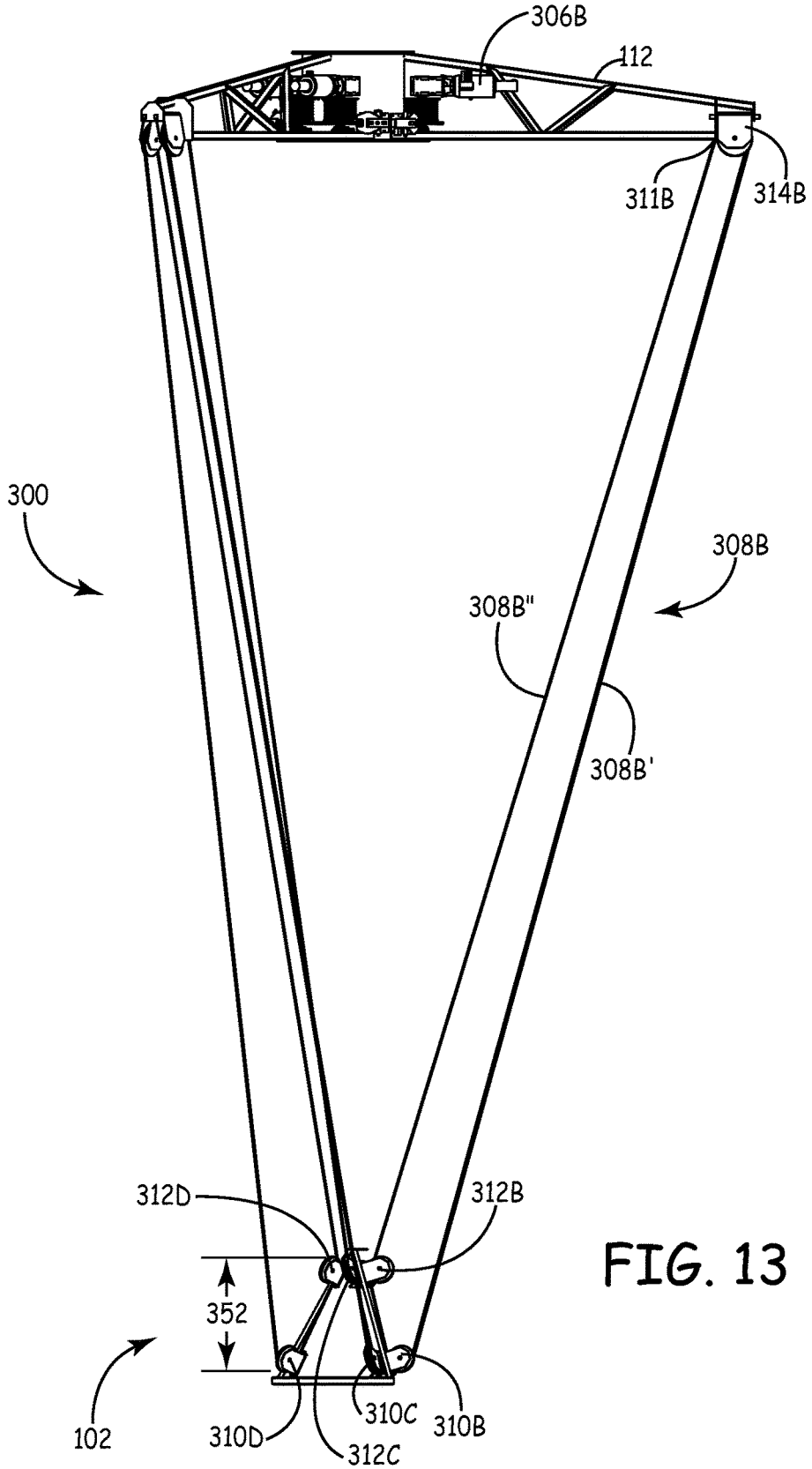
FIG. 13 is a side view of a hoist system having a two part cabling system with the rails removed.

FIG. 13 is a side view of the hoist system 300. FIG. 13 shows an example of wire rope routing that can be used in a 2-part cabling system. In FIG. 13, a first portion 308B' of the wire rope 308B extends from the support arm pulley 314B down to the lower platform pulley 310B. The wire rope 308B then extends from pulley 310B to the upper pulley 312B and forms a wire rope couple between the two pulleys when the wire rope 308B is in tension. Similar wire rope couples are present using the other wire ropes and associated pulleys. From pulley 312B, the wire rope forms a second portion 308B" that extends between the pulley 312B and the upper platform remote attachment point 311B. In an embodiment, the hoist 306B controls the length of wire rope 308B between it and the attachment point 311B. The other wire ropes illustratively form a 2-part cabling system in the same or similar manner as the wire rope 308B, and the length of each of the wire ropes can be increased or decreased in combination with each other to control the position the lower platform 102.

Figure 14:
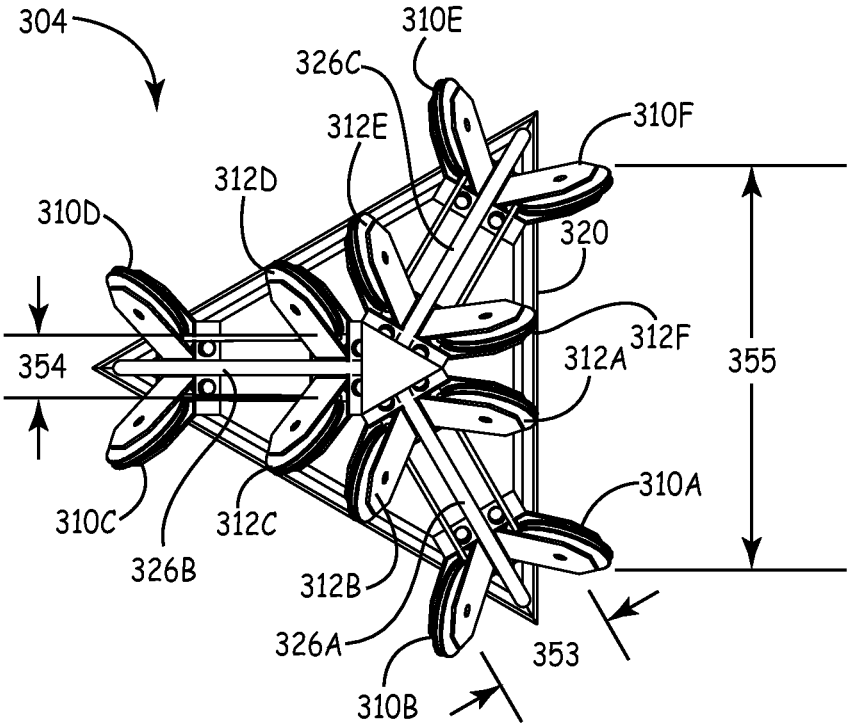
FIG. 14 is a top down view of a spine assembly that can be used in a two part cabling system.

FIG. 14 a top down view of one embodiment of a spine assembly 304 for the lower platform 102 of the hoist system 300. The spine assembly 304 has a support structure 320 for mounting pulleys 310A-310F and 312A-312F in spaced-apart relationship to each other. In particular, a pair of pulleys 310A-310F and 312A-312F is associated with each of the wire ropes 308A-308F (shown and labeled in FIG. 9), respectively. In this embodiment, each pair of pulleys includes a pulley 310A-310F from a first set of pulleys that is closest to the upper platform 104, and a pulley 312A-312F from a second set of pulleys that is further from the upper platform 104. In the embodiment illustrated, the spine assembly 304 is in the form of a pyramid or a three dimensional triangular structure herein comprising three support members 326A, 326B and 326C forming a tripod; however, other support structures to effectuate this geometry for the pulleys could also be used including a single upstanding pole, although a multi-element structure can provide increased stiffness. Therefore, it should be understood that the configuration of the spine assembly 304 can take yet other forms and should not be limited to those described herein.

In the illustrated embodiment, the pulleys of the first set 312A-F are regularly closer together than the pulleys of the second set 310A-F. As indicated above, pulleys from the first set 312A-F and pulleys from the second set 310A-F are organized in pairs. Use of the spine assembly 304 so as to provide spaced-apart pulleys for each of the wire ropes 308A-308F in effect provides a couple using the wire ropes 308A-308F which can provide increased fidelity of control during movements of the lower platform 102, and in particular, angular movements (i.e., pitch, yaw and/or roll of the lower platform 102 with respect to a three orthogonal axes). In addition, the spine assembly 304 provides improved stiffness of the hoist system 300, particularly stiffness or rigidity to moments of angular movements (pitch, yaw and/or roll) of the lower platform 102. These benefits are realized due to the couple that is formed on the lower platform 102 by the set of two spaced apart pulleys 310A-310F and 312A-312F, respectively, provided for each wire rope 308A-308F.

Figure 15:
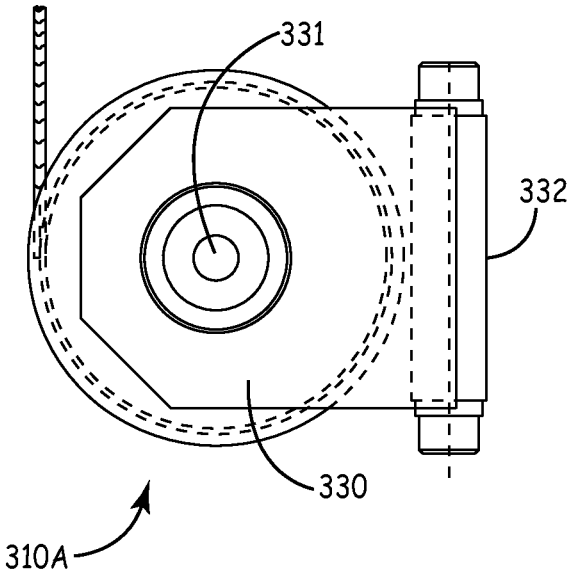
FIG. 15 is a side view of a pulley that can be used in hoist systems.

It should be noted that each of the pulleys of the first set 312A-F, the second set 310A-F and pulleys 314A-F on the upper platform 104 (shown and labeled in FIG. 12) in this and commonly all the embodiments herein are mounted so as to allow pivoting motion of the pulley. FIG. 15 shows a side view of one example of a pulley 310A that can be used. Embodiments are not however limited to any particular pulleys and can use pulleys differing from the specific example shown in the figure. In FIG. 15, the pulley 310A includes support members 330 providing an axis of rotation 331 for the pulley 310A. The pulley 310A is also allowed to pivot about an axis remote from the axis of rotation. In particular, the support members 330 are pivotally connected to a fixed support structure 332 so as to allow pivotal motion and in essence provide a hinge joint.

Figure 16:
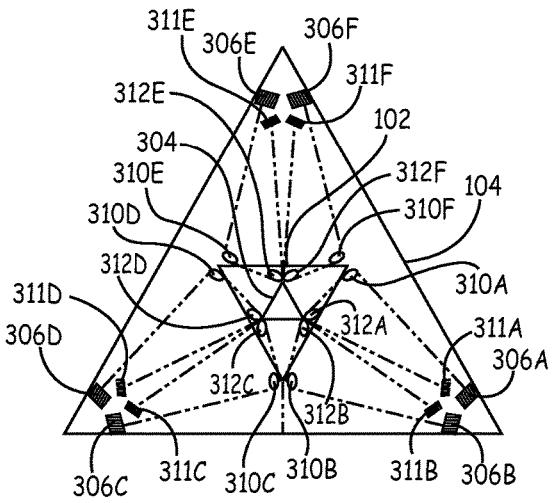
FIG. 16 is a schematic diagram of a six wire rope spine configuration.

FIG. 16 schematically illustrates the hoist system 300, where the upper platform 104, the lower platform 102 and the spine assembly 304 are represented by triangles, nevertheless this should not be considered limiting. In FIG. 16, the wire ropes are represented by the dashed lines. As can be seen in the figure, wire ropes extend from the hoists 306A-F to the lower pulleys 310A-F. It should be noted that in this schematic illustration and in the others that follow that the hoists depicted can in effect represent the point at which the wire rope extends from the platform 104. Hence for many embodiments this would correspond to the pulleys such as pulleys 314A-314F at the remote ends of the support arms 112. From the lower pulleys 310A-F, each of the wire ropes forms a couple between its lower pulley 310A-F and its upper pulley 312A-F. The wire rope then returns to the upper platform 104 and is connected to its fixed attachment point 311A-F. Accordingly, FIG. 16 shows that six wire ropes can be used in one embodiment of a 2-part cabling system. As will be demonstrated below, embodiments of 2-part cabling systems are not however limited to embodiments having any specific number of wire ropes and may include more or less than the illustrated six.

Figure 18:
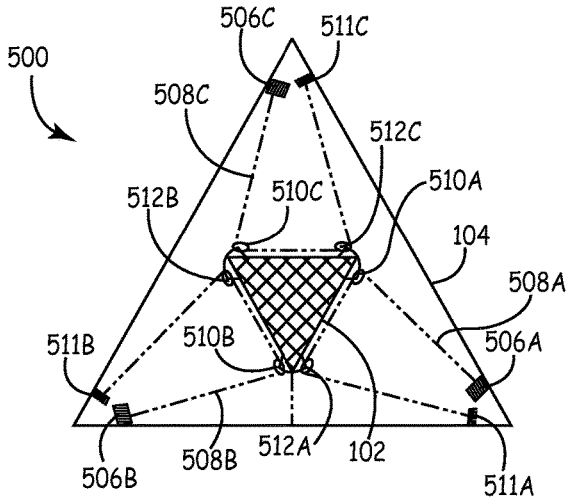
FIG. 18 is a schematic diagram of a three wire rope spine configuration in which the attachment point and hoist for each wire rope are on the same support arm.
Figure 17:
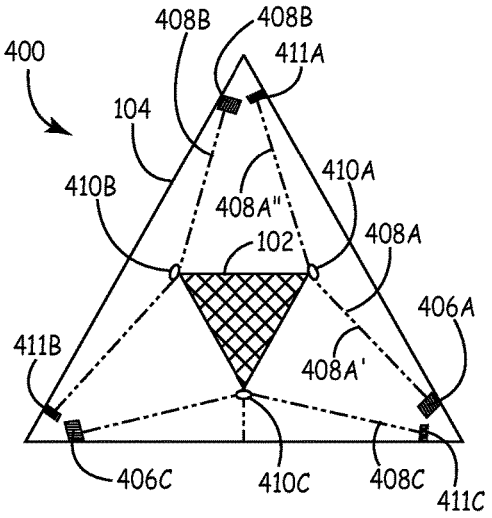
FIG. 17 is a schematic diagram of a three wire rope spine configuration in which the attachment point and hoist for each wire rope are on different support arms.
Figure 19:
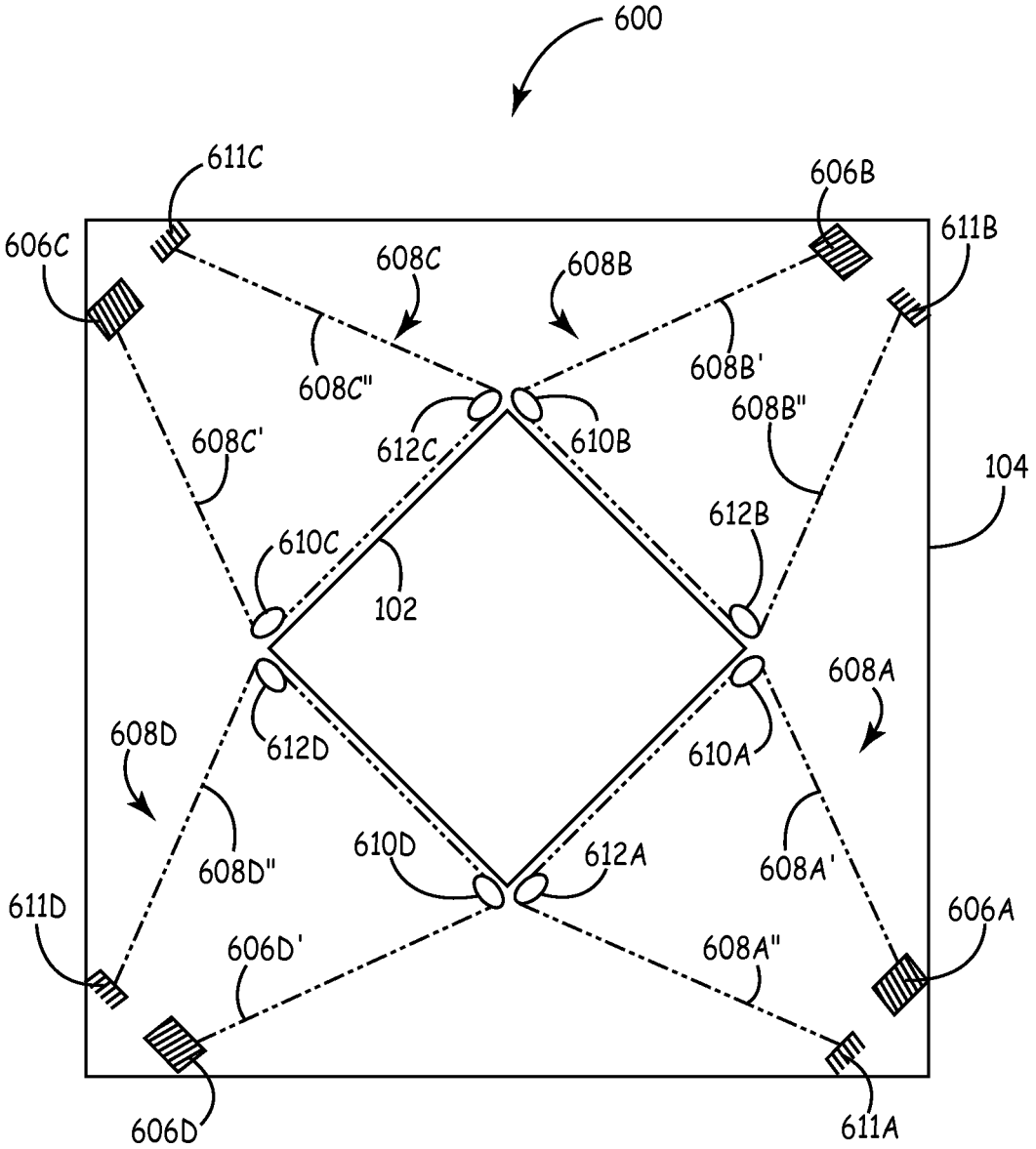
FIG. 19 is a schematic diagram of a four wire rope spine configuration.

FIGS. 17, 18, and 19 schematically illustrate three additional embodiments incorporating 2-part cabling having spaced apart pulleys. Again, it should be noted in these schematic illustrations the hoists depicted can in effect represent the point at which the wire rope extends from the platform 104. Hence for many embodiments this would correspond to the pulleys such as pulleys 314A-314F at the remote ends of the support arms 112. Referring to FIG. 17, a hoist system 400 includes three hoists 406A, 406B and 406C with three corresponding wire ropes 408A, 408B and 408C, and three pulleys 410A, 410B and 410C. In contrast to hoist system 300, the hoists 406A-406C and corresponding attachment points 411A-411C for remote ends of the wire ropes 408A-408C are substantially spaced apart from each other, herein by way of example where the attachment point of a wire rope is positioned proximate the hoist of another wire rope. By locating the attachment points 411A-411C of the wire ropes 408A-408C in a manner spaced apart from the corresponding hoists 406A-406C for the wire rope 408A-408C, the separate portions (e.g. 408A', 408A") under tension are spaced apart from each other, which is believed can provide advantageous operating characteristics such as but not limited to fidelity of control during angular movements (pitch, yaw and/or roll of the lower platform 102) and/or stiffness of the hoist system 400, particularly stiffness or rigidity to moments of angular movements (pitch, yaw and/or roll) of the lower platform 102.

Generally, the benefits discussed above with respect to hoist system 400 are believed also realized in hoist system 500 illustrated in FIG. 18. In this embodiment, each wire rope 508A-508C is guided by two pulleys (one pulley 510A-510C from a first set and second pulley 512A-512C from a second set, respectively, such as in hoist system 300 to form a couple, but in this embodiment, the wire rope portion between the pulleys 510A-510C and 512A-512C of each wire rope 508A-508C is oriented substantially in a plane parallel to or of the plane of the lower platform 102. In contrast, the wire rope portions between the pulleys 310A-310F and 312A-312F for each wire rope 308A-308F in hoist system 300 extend along an associated line that intersects with the plane of the lower platform 102.

FIG. 19 is yet another embodiment of a 2-part cabling hoist system, hoist system 600. Hoist system 600 is similar to system 500 shown in FIG. 18. System 600 differs however from system 500 in that system 500 utilizes three hoists and wire ropes, while system 600 utilizes four hoists and four wire ropes.

In FIG. 19, each wire rope 608A-608D is guided by two pulleys (one pulley 610A-610D from a first set and one pulley 612A-612D from a second set) such as in hoist system 500 to form a couple. Again, like in system 500, the couple formed between the pulleys 610A-610D and 612A-612D of each wire rope 608A-608D is oriented substantially in a plane parallel to or of the plane of the lower platform 102.

Various parameters of the hoist systems 100, 200, 300, 400, 500, and 600 can be adjusted (or are monitored or sensed in order to provide accurate positioning of the lower platform 102) depending on the specific application to which it is intended. Using by way of example hoist system 300, FIGS. 12-14 illustrate at least some of the parameters which can be controlled by and/or comprise an input to a system controller discussed below. For example, in FIG. 12, the side distance between remote ends of the adjacent support arms 112 is indicated by distance 351. In one embodiment, this is a fixed distance, while in other embodiments, the support arms 112 can be extendable; hence this parameter may be adjustable. In general, any of the parameters illustrated in FIGS. 12-14, which are fixed due to the stationary manner in which the elements to which the parameter pertains is depicted can be adjustable in a manner similar to that of the support arms 112, for example, through the use of actuators and mounting assemblies that allow the distance between elements to vary. For instance, in FIG. 13, the height of the spine assembly 352 can be adjusted by using adjustable support elements (e.g. actuators) forming the support structure of the spine assembly 304 and/or allowing one or both of the pulleys 310A-310F, 312A-312F joined thereto to move relative each other, that being with respect to each wire rope 308A-308F. Some parameters may vary due to simply due to movement of the lower platform 102 and as such may be considered as having a nominal value for purposes of design or control. If desired, these parameters may be monitored or sensed. Some examples of such parameters include distances 353, 354, and 355 in FIG. 14, which are the distances between adjacent pulleys and which vary due to the pivoting or hinged mounting assembly for the pulleys 310A-310F, 312A-312F and 314A-314F described above. With respect to the other hoist systems, the same, similar or different parameters can be fixed, adjustable and/or sensed as desired.

Figure 20:
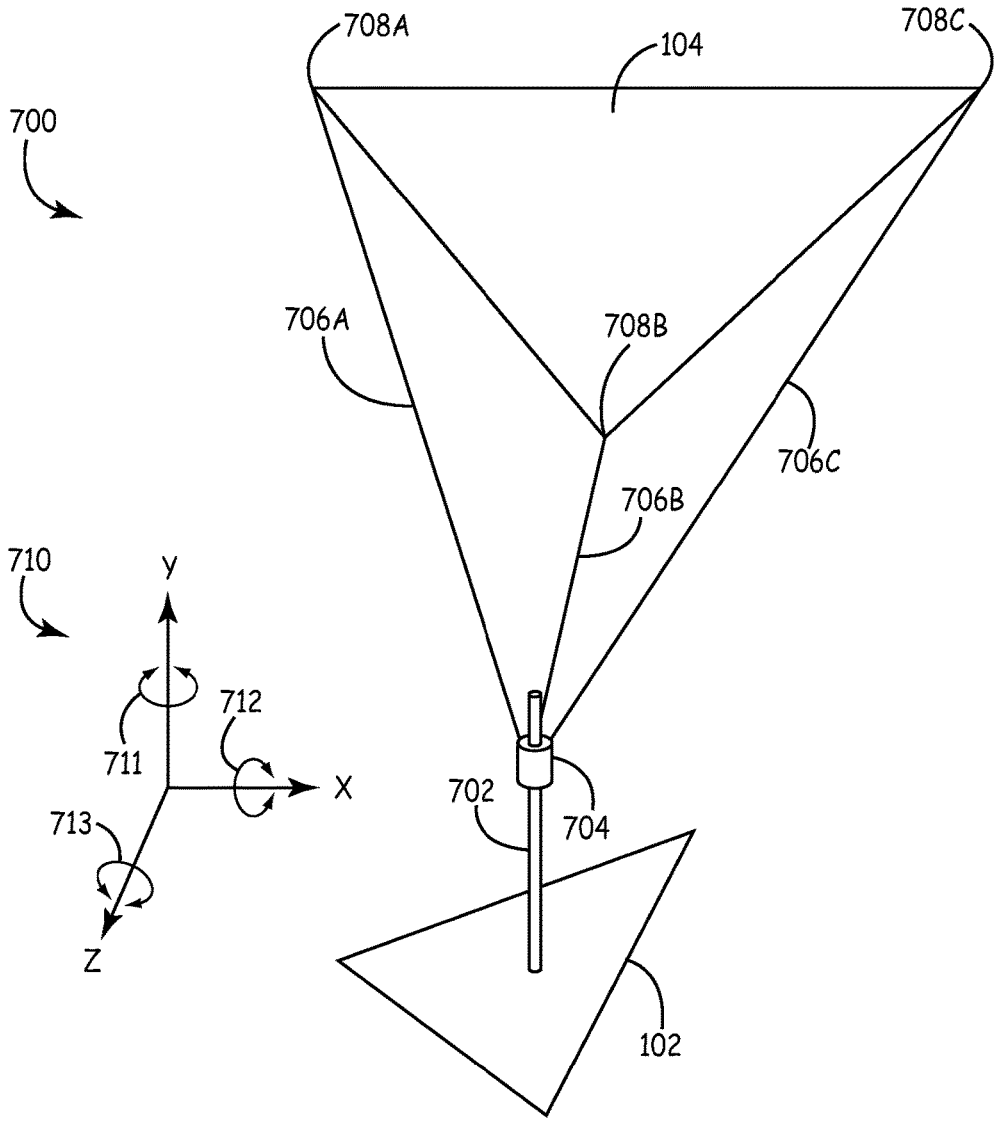
FIG. 20 is a schematic diagram of a collar system.

FIG. 20 is a schematic illustration of a collar system 700. As will be described in greater detail below, system 700 illustratively helps to reduce tilting of a lower platform 102 that is connected to an upper platform 104. Platforms 102 and 104 may include any type of platform such as, but not limited to, platforms 102 and 104 shown in FIGS. 1, 6, 8-11, 14 and 16-19. In an embodiment, platforms 102 and 104 are connected through a hoist and cabling system such as any one of those previously described. For example, the platforms 102 and 104 in FIG. 20 are illustratively connected using a six wire rope connection scheme as illustrated in FIG. 1 or 16, or are connected using a three wire rope connection scheme as illustrated in FIG. 17 or 18. Embodiments are not however limited to any particular connection scheme (e.g. hoist system), and embodiments of collar schemes can be used in combination with any method of connecting a lower platform 102 to an upper platform 104.

Collar system 700 illustratively includes a spine or partial spine 702, a collar 704, and spine cables 706A-C. In an embodiment, spine 702 is a rigid or flex resistant member such as, but not limited to, a rod. The collar 704 can have sufficient mass so as to have weight (i.e. "weighted collar") to cause tension in the wire ropes 706A-C used to position the collar 704 on the spine and where the collar 704 slides freely on spine 702. The spine 702 is attached to lower platform 102 such that movement of either spine 702 or platform 102 is translated to the other member.

Weighted collar 704 is illustratively moved in a manner to track the motion of lower portion 102. For example, if the lower portion 102 is moved up a certain distance, weighted collar 704 is moved up approximately the same distance and at approximately the same rate. Embodiments are not limited to any particular method of moving weighted collar 704. In one embodiment, one or more hoists or reels are connected to collar 704 utilizing one or more spine cables. In the specific example shown in FIG. 20, system 700 has three spine cables 706A, 706B, and 706C. Embodiments are not however limited to any particular number of spine cables and may have more or less than the illustrated three (e.g. one, two, four, etc. spine cables). Additionally, FIG. 20 shows spine cables 706A-C joining to upper support 104 at points 708A-C. The cables are not limited to any particular method of joining to the upper platform 104. For instance, the cables may be attached to hoists, reels, or any other systems that can move the weighted collar 704 to track the motion of the lower platform 102.

In one embodiment, the weighted collar 704 has a cylindrical inner aperture that fits around the spine 702. The spine 702 is able to move freely up and down along the y-axis shown in coordinate system 710, and is able to rotate freely about the y-axis in the direction shown by arrow 711 in FIG. 20. FIG. 20 also shows a direction of rotation 712 about an x-axis and a direction of rotation 713 about a z-axis. In an embodiment, system 700 helps to reduce the tilting of lower platform 102 in these directions.

In another embodiment, the spine 702 and the collar 704 are shaped such that they are keyed to each other. For instance, in one embodiment, the spine 702 has a rectangular shape, and the collar 704 has a rectangular aperture that the spine fits within. In such a case, in addition to reducing rotation about the x- and z-axes, 712 and 713, the system also helps to reduce rotation 711 about the y-axis.

As was previously mentioned, in an embodiment, collar 704 allows for spine 702 to move longitudinally (i.e. along the y-axis shown by coordinate system 710). This helps to ensure that an appropriate amount of tension is maintained in the spine cable or cables even if there is some discrepancy in the tracking of collar 704 to lower portion 102. Accordingly, the collar system 700 may help to reduce tilting even if there is less than perfect tracking of movement between collar 704 and lower portion 102.

Figure 21:
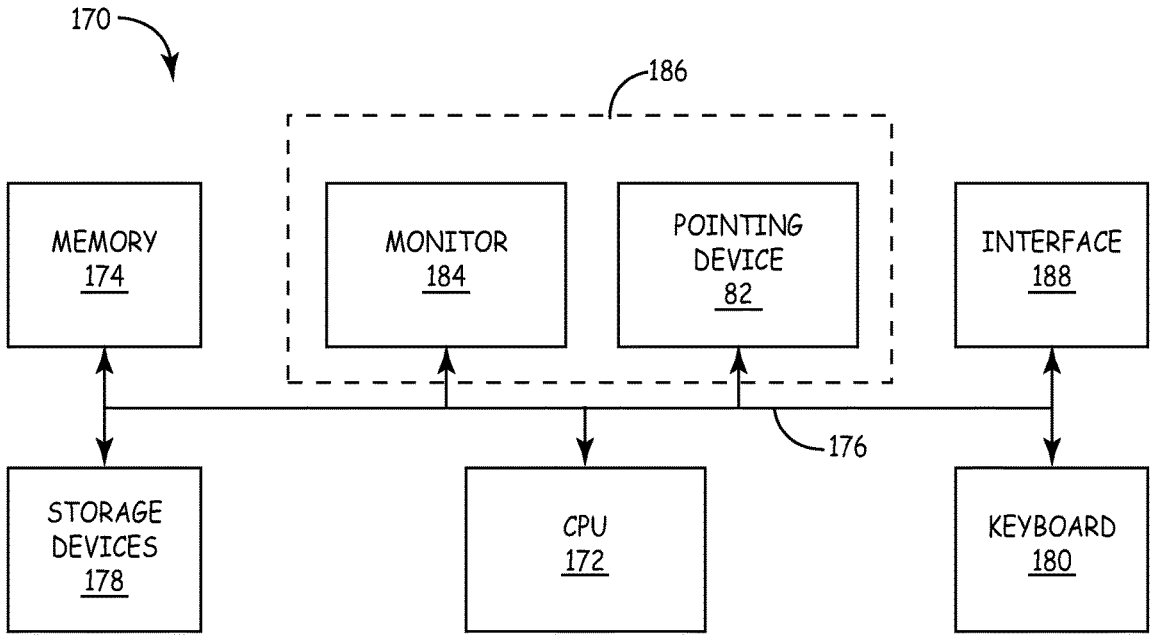
FIG. 21 is a block diagram of a computer that can be used in implementing a hoist system.

The system controller 160 shown in FIG. 1 and usable on all the hoist systems herein described can comprise a digital and/or analog computer. FIG. 21 and the related discussion provide a brief, general description of a suitable computing environment in which the system controller 160 can be implemented. Although not required, the system controller 160 can be implemented at least in part, in the general context of computer-executable instructions, such as program modules, being executed by a computer 170. Generally, program modules include routine programs, objects, components, data structures, etc., which perform particular tasks or implement particular abstract data types. Those skilled in the art can implement the description herein as computer-executable instructions storable on a computer readable medium. Moreover, those skilled in the art will appreciate that the invention may be practiced with other computer system configurations, including multi-processor systems, networked personal computers, mini computers, main frame computers, and the like. Aspects of the invention may also be practiced in distributed computing environments where tasks are performed by remote processing devices that are linked through a communications network. In a distributed computer environment, program modules may be located in both local and remote memory storage devices.

The computer 170 comprises a conventional computer having a central processing unit (CPU) 172, memory 174 and a system bus 176, which couples various system components, including memory 174 to the CPU 172. The system bus 176 may be any of several types of bus structures including a memory bus or a memory controller, a peripheral bus, and a local bus using any of a variety of bus architectures. The memory 174 includes read only memory (ROM) and random access memory (RAM). A basic input/output (BIOS) containing the basic routine that helps to transfer information between elements within the computer 170, such as during start-up, is stored in ROM. Storage devices 178, such as a hard disk, a floppy disk drive, an optical disk drive, etc., are coupled to the system bus 176 and are used for storage of programs and data. It should be appreciated by those skilled in the art that other types of computer readable media that are accessible by a computer, such as magnetic cassettes, flash memory cards, digital video disks, random access memories, read only memories, and the like, may also be used as storage devices. Commonly, programs are loaded into memory 174 from at least one of the storage devices 178 with or without accompanying data.

Input devices such as a keyboard 80 and/or pointing device (e.g. mouse, joystick(s)) 82, or the like, allow the user to provide commands to the computer 170. A monitor 184 or other type of output device can be further connected to the system bus 176 via a suitable interface and can provide feedback to the user. If the monitor 184 is a touch screen, the pointing device 182 can be incorporated therewith. The monitor 184 and input pointing device 182 such as mouse together with corresponding software drivers can form a graphical user interface (GUI) 186 for computer 170. Interfaces 88 on the system controller 60 allow communication to other computer systems if necessary. Interfaces 88 also represent circuitry used to send signals to or receive signals from the actuators and/or sensing devices mentioned above. Commonly, such circuitry comprises digital-to-analog (D/A) and analog-to-digital (A/D) converters as is well known in the art.

Although the subject matter has been described in language directed to specific environments, structural features and/or methodological acts, it is to be understood that the subject matter defined in the appended claims is not limited to the environments, specific features or acts described above as has been held by the courts. Rather, the environments, specific features and acts described above are disclosed as example forms of implementing the claims.

What is claimed is:

1. A hoist system comprising:

a support structure;

a lower platform having a lower reference axis;

an upper platform mounted to the support structure for at least partial rotation about an axis;

a drive connected to the upper platform configured to rotate the upper platform;

a plurality of at least three support arms extending radially from the axis and mounted to the upper platform to rotate about the axis therewith, wherein remote ends of the support arms are spaced apart from each other at equal angular intervals about the axis;

a plurality of at least six flexible members that connects the plurality of at least three support arms to the lower platform, wherein two flexible members of the plurality of at least six flexible member comprise a pair of flexible members extends over a remote end of each support arm downwardly to the lower platform and also toward the axis, wherein the flexible members are joined to the lower platform at locations spaced apart from each other, wherein, when the axis is aligned with the lower reference axis, the flexible members are arranged in a first group and a second group, each group comprising at least three flexible members spaced apart from each other about the axis at equal angular intervals and each flexible member of each group extending between the upper platform and the lower platform at a same angle with respect to the axis as each other flexible member in the same associated group when the axis is aligned with the lower reference axis;

a plurality of at least six hoists that extends and retracts the plurality of at least six flexible members, each of the at least six flexible members operably coupled to, and extended and retracted by, a different one of the at least six hoists in order to move the lower platform vertically and laterally within a work envelope, and wherein each hoist is configured to extend and retract the associated flexible member connected thereto independently from the other plurality of five other hoists, and wherein the plurality of at least six hoists are mounted in pairs to each of the at least three support arms; and a controller operably connected to the drive to selectively rotate the upper platform and connected to each hoist to operate each hoist independently from the other hoists to move the lower platform vertically, laterally and with angular movements comprising pitch and roll with respect to the axis within the work envelope, wherein lateral movement includes extension of the flexible members at different lengths to move the lower platform laterally with respect to the axis.

2. The hoist system of claim 1, and further comprising:

a weighted collar that is suspended from the upper platform and that supports a spine extending from the lower platform.

3. The hoist system of claim 2, wherein the spine extending from the lower platform has a cylindrical shape and fits through a cylindrical aperture in the weighted collar.

4. The hoist system of claim 2, wherein the spine extending from the lower platform has a shape that is keyed to a shape of an aperture in the weighted collar.

5. The hoist system of claim 1, wherein each of the plurality of flexible members utilizes at least one pulley on the lower platform and has an attachment point on one of the plurality of rotatable support arms.

6. The hoist system of claim 5, wherein each of the plurality of flexible members extends from one of the plurality of rotatable support arms and the attachment point for the flexible member is on the same one of the plurality of rotatable support arms.

7. The hoist system of claim 5, wherein each of the plurality of flexible members extends from one of the plurality of rotatable support arms and the attachment point for the flexible member is on a different one of the plurality of rotatable support arms.

8. The hoist system of claim 5, wherein each of the plurality of flexible members utilizes two or more pulleys on the lower platform.

9. The hoist system of claim 1, and further comprising:

a plurality of sensors, each sensor being configured to provide an output corresponding to tension in at least one of the plurality of flexible members.

10. The hoist system of claim 9, and wherein the controller is configured to receive the outputs from the plurality of sensors and provide compensation for elongation of the plurality of flexible members during positioning of the lower platform.

11. The hoist system of claim 10, and wherein the controller is configured to receive the outputs from the plurality of sensors and utilize the outputs to determine if slack is present in one or more of the plurality of flexible members.

12. A hoist system comprising:

a support structure;

a lower platform;

a set of pulleys having a pulley thereof mounted to the lower platform at each of three locations spaced apart from each other about a lower reference axis at equal angular intervals;

an upper platform mounted to the support structure;

a plurality of adjustable length support arms extending radially from a center axis, the support arms being mounted to the upper platform to move therewith, wherein remote ends of the support arms are symmetrically spaced apart from each other and about the center axis, and wherein each support arm is independently adjustable in length;

a plurality of three flexible members that connects the plurality of adjustable length support arms to the lower platform, each of the flexible members extending downwardly to the lower platform and also toward the center axis; wherein each flexible member engages one of the pulleys on the lower platform, wherein each flexible member has a first portion extending from one of the support arms to one of the pulleys on the lower platform and a second portion extending from said one of the pulleys on the lower platform to the support arm having a remote end fixed to the upper platform at each of three locations that are spaced apart from each other about the center axis at equal angular intervals, and wherein when the center axis is aligned with the lower reference axis, the first portions are spaced apart at equal angular intervals about the center axis and have a same angle with respect to the center axis as each other first portion; and the second portions are spaced apart at equal angular intervals about the center axis and have a same angle with respect to the center axis as each other second portion; and a plurality of hoists that extends and retracts the plurality of flexible members, wherein a hoist thereof is mounted to one of the support arms; and a controller operably coupled to each support arm to selectively adjust a length thereof and operably coupled to each of the hoists, wherein the controller is configured to operate each hoist of the plurality of hoists independently from the other hoists to move the lower platform vertically, laterally and with angular movements comprising pitch and roll with respect to the center axis within a work envelope.

13. The hoist system of claim 12, and further comprising:

a plurality of sensors, each sensor being configured to provide an output corresponding to tension in at least one of the plurality of flexible members.

14. The hoist system of claim 13, and wherein the controller is configured to receive the outputs from the plurality of sensors and provide compensation for elongation of the plurality of flexible members during positioning of the lower platform.

15. A hoist system comprising a lower platform having a lower reference axis;

a first set of pulleys having a pulley thereof mounted to the lower platform at each of three locations spaced apart from each other about a lower reference axis at equal angular intervals;

a second set of pulleys having a pulley thereof mounted to the lower platform at each of three locations spaced apart from each other about the lower reference axis at equal angular intervals;

an upper platform having a rotational axis and a plurality of support arms;

a drive connected to the upper platform configured to rotate the upper platform about the rotational axis;

a plurality of extendable and retractable flexible members, each flexible member being guided by one of the first set of pulleys and one of the second set of pulleys so as to form a couple when the corresponding flexible member is in tension and having a remote end joined to the upper platform, wherein each flexible member has a first portion extending from one of the support arms to one of the pulleys of the first set on the lower platform and a second portion extending from one of the pulleys of the second set on the lower platform, and wherein when the rotational axis is aligned with the lower reference axis, the first portions are spaced apart at equal angular intervals about the rotational axis and have a same angle with respect to the rotational axis as each other first portion; and the second portions are spaced apart at equal angular intervals about the rotational axis and have a same angle with respect to the rotational axis as each other second portion;

a plurality of hoists, each hoist extending and retracting one of the plurality of flexible members to move the lower platform vertically and laterally and with angular movements comprising pitch, yaw and roll within a work envelope with respect to the rotational axis; and a controller operably connected to the drive to selectively rotate the upper platform and connected to each hoist to operate each hoist independently from the other hoists to move the lower platform vertically, laterally and with angular movements comprising pitch and roll with respect to the rotational axis within the work envelope, wherein lateral movement includes extension of the flexible members at different lengths to move the lower platform laterally with respect to the axis.

16. The hoist system of claim 15, wherein each couple comprises a third portion of the flexible member extending between the associated pulley of the first set of pulleys and the associated pulley of the second set of pulleys, and wherein each of said third portions extends along a line that is parallel to or in the plane of the lower platform.

17. The hoist system of claim 15, wherein each couple comprises a third portion of the flexible member extending between the associated pulley of the first set of pulleys and the associated pulley of the second set of pulleys, and wherein each of said third portions intersects with the plane of the lower platform.

18. The hoist system of claim 15, wherein the remote end of each flexible member is secured so as to form two spaced apart portions that are in tension.

19. The hoist system of claim 1, wherein each support arm includes an actuator coupled thereto to adjust a length of the corresponding support arm, and wherein connection of the lower platform to the upper platform with the flexible members is configured such that extension of all of the support arms increases a height of the lower platform when the hoists fully retract the associated flexible members, wherein the controller operably is coupled to each of the actuators.

20. The hoist system of claim 15, wherein each couple comprises a third portion of the flexible member extending between the associated pulley of the first set of pulleys and the associated pulley of the second set of pulleys; wherein the plurality of support arms extend equally and radially from the rotational axis extending between the upper and lower platforms, the support arms being mounted to the upper platform to move therewith; and wherein each of the flexible members extends downwardly to the lower platform and also toward the rotational axis.

21. The hoist system of claim 15 wherein the support arms are adjustable in length and are mounted to the upper platform to move therewith, wherein each support arm includes an actuator coupled thereto to adjust a length of the corresponding support arm and wherein one of the hoists is mounted on each support arm; and wherein connection of the lower platform to the upper platform with the flexible members is configured such that extension of all of the support arms increases a height of the lower platform when the hoists fully retract the associated flexible members.

* * * * *